US007156265B2

(12) United States Patent
Walsh et al.

(10) Patent No.: US 7,156,265 B2
(45) Date of Patent: Jan. 2, 2007

(54) CONTAINER

(75) Inventors: Michael J. Walsh, Chesterfield, MO (US); Jeffrey A. Schutte, University City, MO (US); Mark A. Gilbertson, Sauk City, WI (US); Michael J. Brock, Madison, WI (US); Scott G. Manke, Sun Prairie, WI (US); Matthew G. Ackerman, Arena, WI (US)

(73) Assignee: Masterchem Industries LLC, Imperial, MO (US)

( * ) Notice: Subject to any disclaimer, the term of this patent is extended or adjusted under 35 U.S.C. 154(b) by 382 days.

(21) Appl. No.: 10/255,564

(22) Filed: Sep. 25, 2002

(65) Prior Publication Data

US 2003/0121941 A1 Jul. 3, 2003

Related U.S. Application Data

(63) Continuation-in-part of application No. 10/132,682, filed on Apr. 25, 2002, now Pat. No. 7,014,078, which is a continuation-in-part of application No. 10/006,985, filed on Dec. 5, 2001, now Pat. No. 7,063,693.

(51) Int. Cl.
*A47G 19/14* (2006.01)

(52) U.S. Cl. ..... 222/465.1; 222/109; 222/143; 220/696; 220/759; 220/760; 16/425

(58) Field of Classification Search ..... 222/465.1, 222/566–568, 475, 109, 143; 220/755, 696, 220/752, 756, 759–761, 763; 206/510; 16/110.1, 425
See application file for complete search history.

(56) References Cited

U.S. PATENT DOCUMENTS 164,128 A 6/1875 Babbit
1,196,492 A 8/1916 Sykes
1,199,680 A 9/1916 Fabian
1,448,446 A 3/1923 Hulbert
1,488,397 A 3/1924 Judge et al.
1,696,240 A 12/1928 Kircher
1,755,763 A 4/1930 Barber
1,873,624 A * 8/1932 Moxey ..... 222/465.1
1,893,604 A 1/1933 Van Rossem
1,947,398 A 2/1934 Stühler
1,952,288 A 3/1934 Saxon
2,006,451 A 7/1935 Glidden
2,022,527 A 11/1935 Schletz (Continued)

FOREIGN PATENT DOCUMENTS

BE 000518014 3/1953

(Continued)

OTHER PUBLICATIONS

*Reed Invest In PET Paint Cans*, Plastics & Rubber Weekly, Feb. 3, 1990, at 8 (Croydon; Surrey, England).

(Continued)

*Primary Examiner*—Frederick C. Nicolas
(74) *Attorney, Agent, or Firm*—Foley & Lardner LLP

(57) ABSTRACT

A paint container includes a top, a bottom, and at least one side wall. A handle is pivotally attached to the body proximate the top. A recess is disposed in the handle proximate the top of the container when the handle is in a rest position. The handle includes an indentation to receive a hook for supporting the container. The handle also includes a pair of tabs that are received in recesses in the bottom for positive location and secure stacking.

3 Claims, 16 Drawing Sheets

U.S. PATENT DOCUMENTS

| | | | | |
|---|---|---|---|---|
| 2,060,932 | A | | 11/1936 | Friermood |
| 2,077,027 | A | | 4/1937 | Torras |
| 2,120,487 | A | | 6/1938 | Conner |
| 2,324,338 | A | | 7/1943 | Tripp |
| 2,347,401 | A | | 4/1944 | Davey |
| 2,374,430 | A | | 4/1945 | Hexter |
| 2,387,270 | A | | 10/1945 | Johnson |
| 2,601,039 | A | | 6/1952 | Livingstone |
| 2,690,281 | A | | 9/1954 | Livingstone |
| D174,365 | S | | 3/1955 | Wilson |
| 2,743,844 | A | | 5/1956 | Livingstone |
| 2,763,402 | A | | 9/1956 | Livingstone |
| 2,763,403 | A | | 9/1956 | Livingstone |
| 2,787,402 | A | | 4/1957 | Stiner et al. |
| 2,797,902 | A | | 7/1957 | Beugler |
| 2,848,019 | A | | 8/1958 | Corbin et al. |
| 2,848,142 | A | | 8/1958 | Livingstone |
| 2,851,196 | A | | 9/1958 | Livingstone |
| 2,889,079 | A | | 6/1959 | Livingstone |
| 2,894,309 | A | | 7/1959 | Brzowski |
| 2,921,330 | A | | 1/1960 | Prytikin |
| 2,935,223 | A | | 5/1960 | Crowley |
| 3,015,415 | A | | 1/1962 | Marsh et al. |
| 3,018,092 | A | | 1/1962 | Johnson |
| 3,066,830 | A | | 12/1962 | Heiss et al. |
| 3,074,597 | A | | 1/1963 | Felts |
| 3,085,710 | A | | 4/1963 | McIlroy |
| 3,122,272 | A | | 2/1964 | Marsh |
| 3,138,284 | A | | 6/1964 | Henchert |
| 3,158,284 | A | * | 11/1964 | Henchert et al. ..... 220/752 |
| 3,214,052 | A | | 10/1965 | Dike |
| 3,220,048 | A | | 11/1965 | Wei |
| 3,275,366 | A | | 9/1966 | Hidding |
| 3,284,057 | A | | 11/1966 | Duquette |
| D206,407 | S | | 12/1966 | Sharp |
| 3,291,295 | A | | 12/1966 | Caligiuri |
| 3,298,561 | A | | 1/1967 | McConnie |
| 3,300,104 | A | | 1/1967 | Burt |
| 3,301,534 | A | | 1/1967 | Orser |
| 3,307,752 | A | * | 3/1967 | Anderson ..... 222/465.1 |
| 3,323,691 | A | | 6/1967 | Ruetz |
| D208,276 | S | | 8/1967 | Moore |
| 3,387,749 | A | | 6/1968 | Godshalk et al. |
| 3,412,887 | A | | 11/1968 | Swartwood et al. |
| 3,419,196 | A | * | 12/1968 | Moore ..... 222/465.1 |
| 3,451,590 | A | | 6/1969 | Johnson et al. |
| 3,463,366 | A | | 8/1969 | Spencer |
| D217,231 | S | | 4/1970 | Pashman |
| 3,542,344 | A | | 11/1970 | Oberhauser |
| 3,590,416 | A | | 7/1971 | Henningsen |
| 3,612,595 | A | | 10/1971 | Updegraff |
| 3,620,410 | A | | 11/1971 | Greise, Jr. |
| 3,659,758 | A | | 5/1972 | Waterman |
| 3,679,103 | A | | 7/1972 | Chmela et al. |
| 3,695,488 | A | | 10/1972 | Olsson |
| 3,727,792 | A | | 4/1973 | Levin |
| 3,735,962 | A | | 5/1973 | Pagano |
| 3,735,964 | A | | 5/1973 | Lorenzen |
| 3,744,671 | A | | 7/1973 | Saunders, Jr. |
| 3,807,679 | A | | 4/1974 | Burke et al. |
| 3,833,150 | A | | 9/1974 | Visser-Patings |
| 3,853,249 | A | | 12/1974 | Weir, Jr. et al. |
| 3,866,791 | A | | 2/1975 | Roper et al. |
| 3,880,408 | A | | 4/1975 | Karjalainen |
| 3,899,107 | A | | 8/1975 | Gaal |
| 3,924,775 | A | * | 12/1975 | Andreaggi et al. ..... 220/756 |
| 3,942,688 | A | | 3/1976 | Pryor et al. |
| 3,945,527 | A | | 3/1976 | Pylant |
| 3,972,453 | A | | 8/1976 | Kapples |
| 3,980,213 | A | | 9/1976 | Ramsay |
| 4,009,802 | A | | 3/1977 | Hayduchok |
| 4,014,465 | A | | 3/1977 | Ritter |
| 4,033,473 | A | | 7/1977 | Raley et al. |
| 4,051,984 | A | | 10/1977 | Ho |
| 4,061,242 | A | | 12/1977 | Donlon |
| 4,078,700 | A | | 3/1978 | Hidding |
| 4,118,801 | A | | 10/1978 | Kraft et al. |
| 4,125,210 | A | | 11/1978 | Embree |
| 4,128,189 | A | | 12/1978 | Baxter |
| 4,150,763 | A | | 4/1979 | Simpson |
| 4,189,804 | A | | 2/1980 | Flowerday |
| 4,203,537 | A | | 5/1980 | McAlister |
| 4,222,485 | A | | 9/1980 | Focke |
| 4,225,064 | A | | 9/1980 | Westcott |
| 4,227,623 | A | | 10/1980 | Woinarski |
| 4,235,348 | A | | 11/1980 | Watson |
| 4,235,553 | A | | 11/1980 | Gall |
| 4,240,568 | A | | 12/1980 | Pool |
| D258,563 | S | | 3/1981 | Romagnoli |
| 4,266,686 | A | | 5/1981 | Carter |
| 4,281,936 | A | | 8/1981 | Schotter et al. |
| D261,362 | S | | 10/1981 | Epperson |
| 4,298,145 | A | | 11/1981 | Iida |
| 4,312,459 | A | | 1/1982 | Leach |
| 4,329,068 | A | | 5/1982 | Neuner et al. |
| 4,351,454 | A | | 9/1982 | Maynard, Jr. |
| D267,631 | S | | 1/1983 | Beechuk |
| 4,387,828 | A | | 6/1983 | Yates, Jr. |
| 4,387,922 | A | | 6/1983 | Geisinger |
| 4,399,926 | A | * | 8/1983 | Eidels-Dubovoy ..... 220/288 |
| 4,440,328 | A | | 4/1984 | De Freitas |
| 4,445,782 | A | | 5/1984 | Sparrow, Jr. |
| 4,446,986 | A | | 5/1984 | Bowen et al. |
| 4,474,303 | A | | 10/1984 | Maccise |
| D276,890 | S | | 12/1984 | Hancher |
| 4,491,234 | A | | 1/1985 | Wilcock |
| 4,497,581 | A | | 2/1985 | Miller |
| 4,520,936 | A | | 6/1985 | Lyons |
| D279,763 | S | | 7/1985 | Hestehave et al. |
| 4,541,529 | A | | 9/1985 | Hestehave et al. |
| 4,550,862 | A | | 11/1985 | Barker et al. |
| 4,568,194 | A | | 2/1986 | Gargioni |
| 4,583,666 | A | | 4/1986 | Buck |
| 4,588,302 | A | | 5/1986 | Pizzi et al. |
| 4,601,406 | A | | 7/1986 | Dudzik |
| 4,615,456 | A | | 10/1986 | Cousar |
| 4,619,372 | A | | 10/1986 | McFarland |
| 4,632,888 | A | * | 12/1986 | Kump et al. ..... 429/187 |
| 4,643,325 | A | | 2/1987 | Streit |
| D288,535 | S | | 3/1987 | Bozich |
| D289,377 | S | | 4/1987 | Ashby et al. |
| 4,669,640 | A | | 6/1987 | Ando et al. |
| 4,671,421 | A | | 6/1987 | Reiber et al. |
| 4,696,416 | A | | 9/1987 | Muckenfuhs et al. |
| D292,489 | S | | 10/1987 | Kowollik et al. |
| D292,490 | S | | 10/1987 | Kowollik et al. |
| D292,491 | S | | 10/1987 | Ross et al. |
| D292,492 | S | | 10/1987 | Ross et al. |
| 4,702,395 | A | | 10/1987 | Nitsch |
| 4,705,083 | A | | 11/1987 | Rossetti |
| 4,706,829 | A | | 11/1987 | Li |
| 4,713,064 | A | | 12/1987 | Bruno et al. |
| 4,736,874 | A | | 4/1988 | Durant |
| D296,420 | S | | 6/1988 | Frahm et al. |
| 4,752,543 | A | * | 6/1988 | Anderson et al. ..... 429/179 |
| D296,671 | S | | 7/1988 | Jordan |
| 4,771,501 | A | | 9/1988 | Leiter |
| 4,773,560 | A | | 9/1988 | Kittscher |
| 4,789,245 | A | | 12/1988 | Morbeck |
| 4,799,306 | A | | 1/1989 | Collins et al. |
| 4,804,119 | A | | 2/1989 | Goodall |
| 4,805,793 | A | * | 2/1989 | Brandt et al. ..... 215/10 |
| 4,813,785 | A | | 3/1989 | Miller |
| 4,830,234 | A | | 5/1989 | Odet |

D302,526 S 8/1989 Ritter
4,865,282 A 9/1989 Yonkman et al.
D304,014 S 10/1989 O'Connell
D304,296 S 10/1989 Wilson et al.
D305,407 S 1/1990 Gonda
4,890,770 A 1/1990 Haga et al.
4,892,207 A 1/1990 Cullis
4,893,723 A 1/1990 Seabolt
4,895,269 A * 1/1990 Cade ..... 220/695
4,896,415 A 1/1990 Bock
4,911,319 A 3/1990 DeJean
D306,968 S 4/1990 Blair
4,917,268 A 4/1990 Campbell et al.
4,927,046 A 5/1990 Armstrong
4,928,839 A 5/1990 Kruelskie
4,941,586 A 7/1990 Tarna
4,949,884 A 8/1990 Dahl
4,967,938 A 11/1990 Hellenberg
4,984,714 A 1/1991 Sledge
4,993,565 A 2/1991 Ota et al.
4,993,605 A 2/1991 Del'Re
5,012,960 A 5/1991 Arnold
5,020,699 A 6/1991 Sams
5,022,559 A 6/1991 Condon
D318,228 S 7/1991 Schlesselman
5,037,002 A 8/1991 Tschanen
5,050,996 A 9/1991 Allen
D320,911 S 10/1991 Carlson
5,058,772 A 10/1991 Moore et al.
D321,325 S 11/1991 Petrus
D321,624 S 11/1991 Fiore et al.
5,064,101 A 11/1991 Richter et al.
5,065,937 A 11/1991 Ritter
D322,221 S 12/1991 Neff
D323,115 S 1/1992 Kelsey
D323,456 S 1/1992 Gonda
5,078,289 A 1/1992 Bolton et al.
5,108,009 A 4/1992 Davidson et al.
5,123,576 A 6/1992 Lawrence
D329,576 S 9/1992 Desjardin
5,158,216 A 10/1992 Viani
D331,094 S 11/1992 Sterett
5,160,067 A 11/1992 Luber
D332,747 S 1/1993 Darr et al.
5,176,281 A 1/1993 Fiore
5,184,749 A 2/1993 Attenasio
5,195,662 A 3/1993 Neff
5,197,802 A 3/1993 Miller et al.
5,207,356 A 5/1993 Krall
5,226,553 A 7/1993 Fiore
5,234,130 A 8/1993 Benioff et al.
5,234,133 A 8/1993 Kensey
5,251,788 A 10/1993 Moore
5,268,620 A 12/1993 Hellenberg
5,269,438 A * 12/1993 Kelsey ..... 220/766
5,287,990 A 2/1994 Knox
5,299,710 A 4/1994 Welsch et al.
5,307,956 A 5/1994 Richter et al.
5,316,054 A 5/1994 Hall et al.
D347,790 S 6/1994 Lathrop et al.
5,320,260 A 6/1994 Song et al.
5,337,910 A 8/1994 Picozza et al.
5,339,487 A * 8/1994 Kasper ..... 15/246.2
5,344,041 A 9/1994 Luburic et al.
D351,792 S 10/1994 Morris, Sr.
D352,459 S 11/1994 Pollacco
D352,659 S 11/1994 Nilsson et al.
5,377,858 A 1/1995 Morris, Sr.
5,377,863 A 1/1995 Widman
5,383,163 A 1/1995 Brunn
D355,366 S 2/1995 Bainton
D357,780 S 4/1995 Breen
5,415,956 A * 5/1995 Ching ..... 429/187
5,435,467 A * 7/1995 Ekkert et al. ..... 222/109
5,443,184 A 8/1995 Broitzman
5,443,314 A 8/1995 Gatlin
5,445,425 A 8/1995 Lyver
D362,180 S 9/1995 Haines
5,457,850 A 10/1995 Knox
5,458,416 A 10/1995 Edwards et al.
5,461,755 A 10/1995 Hardigg et al.
5,462,353 A 10/1995 Gatlin
5,468,068 A 11/1995 Hotchkiss, III
5,469,986 A 11/1995 Jang
5,472,111 A 12/1995 Renfrew
5,472,121 A 12/1995 Silano
5,474,211 A 12/1995 Hellenberg
D366,617 S 1/1996 Hotz
5,493,840 A 2/1996 Cane
D368,032 S 3/1996 Couto
5,505,331 A 4/1996 Rathbun
5,507,543 A * 4/1996 Shefflin ..... 294/146
5,507,574 A 4/1996 Dickey
5,507,575 A 4/1996 Rossetti
D370,153 S 5/1996 Chaney et al.
5,533,802 A 7/1996 Garganese
5,547,091 A 8/1996 Neveras et al.
5,553,701 A 9/1996 Jarecki et al.
D374,178 S 10/1996 Valls et al.
5,566,861 A 10/1996 Serano
5,566,862 A 10/1996 Haffner et al.
5,568,879 A 10/1996 Kovathana
5,579,556 A * 12/1996 Chung ..... 16/110.1
5,582,315 A 12/1996 Reid
5,584,430 A 12/1996 Mulry
5,597,090 A 1/1997 Leahy
5,603,787 A 2/1997 Reid
D379,302 S 5/1997 Rodman
5,626,258 A 5/1997 Maiorino
5,626,298 A 5/1997 Arnoldy
5,637,420 A 6/1997 Jones, Jr. et al.
5,641,089 A 6/1997 Palank
5,649,650 A 7/1997 Klauke
D383,392 S 9/1997 Quayle et al.
5,662,242 A 9/1997 Steo
5,662,416 A 9/1997 Dwigans, II
5,669,526 A 9/1997 Keyfauver
5,678,684 A 10/1997 Wright
5,683,009 A 11/1997 King
5,697,703 A 12/1997 Lucchetti
5,704,506 A 1/1998 Tobias et al.
5,704,711 A 1/1998 Simmons
5,709,314 A 1/1998 Petry
5,711,601 A 1/1998 Thomas et al.
D391,490 S 3/1998 Wilson
D392,160 S 3/1998 Schmidt
5,730,331 A 3/1998 Johnson
D393,520 S 4/1998 Christy
5,743,445 A 4/1998 Benarrouch
5,758,886 A 6/1998 Mayer
5,779,051 A 7/1998 Boutin
5,787,839 A 8/1998 Magnant et al.
5,788,371 A 8/1998 Neri et al.
5,794,803 A * 8/1998 Sprick ..... 215/217
5,810,196 A 9/1998 Lundy
5,823,345 A 10/1998 Nask et al.
5,823,385 A 10/1998 Cautereels
5,850,953 A 12/1998 Dallas, Jr.
5,855,299 A 1/1999 Arnold et al.
5,855,304 A 1/1999 Dean et al.
5,862,941 A 1/1999 Jones
D405,014 S 2/1999 Nask et al.
5,890,628 A 4/1999 Simpson et al.
5,893,489 A 4/1999 Giarrante
5,896,993 A 4/1999 Nask et al.
5,904,269 A * 5/1999 Wolff ..... 220/756

| | | | | |
|---|---|---|---|---|
| 5,906,433 | A | 5/1999 | Mazzalveri | |
| 5,913,450 | A | 6/1999 | Runkel | |
| 5,921,448 | A | 7/1999 | Stewart | |
| 5,927,499 | A | 7/1999 | Vesborg | |
| 5,927,535 | A | 7/1999 | Goth | |
| 5,931,324 | A | 8/1999 | Lyons et al. | |
| 5,941,422 | A | 8/1999 | Struble | |
| 5,941,427 | A | 8/1999 | Speer | |
| D415,597 | S | 10/1999 | Neff | |
| D415,687 | S | 10/1999 | Lai et al. | |
| 5,971,201 | A | 10/1999 | Daw | |
| 5,988,418 | A | 11/1999 | Maeshima | |
| 6,029,858 | A | 2/2000 | Srokose et al. | |
| 6,050,455 | A | 4/2000 | Soehnlen et al. | |
| 6,053,345 | A | 4/2000 | Jones | |
| D424,440 | S | 5/2000 | Wilkinson et al. | |
| D425,792 | S | 5/2000 | Haller | |
| 6,059,153 | A | 5/2000 | Olson et al. | |
| 6,068,161 | A | 5/2000 | Soehnlen et al. | |
| 6,085,949 | A | 7/2000 | Zimny et al. | |
| D428,763 | S | 8/2000 | Hashimoto | |
| D428,817 | S | 8/2000 | Olson et al. | |
| 6,119,890 | A | 9/2000 | Kawamata | |
| 6,123,231 | A | 9/2000 | Geisinger | |
| D431,472 | S | 10/2000 | Cain et al. | |
| 6,126,048 | A | 10/2000 | Bublitz | |
| 6,138,853 | A | 10/2000 | Frechette | |
| 6,138,963 | A | 10/2000 | Malvasio | |
| D435,445 | S | 12/2000 | Arai et al. | |
| 6,158,632 | A | 12/2000 | Ekkert | |
| 6,179,158 | B1 | 1/2001 | Koda | |
| 6,186,352 | B1 | 2/2001 | Hwang | |
| 6,189,725 | B1 | 2/2001 | Monico | |
| 6,209,762 | B1 | 4/2001 | Haffner et al. | |
| 6,213,338 | B1 * | 4/2001 | Cogdill | 220/700 |
| 6,223,945 | B1 | 5/2001 | Giblin et al. | |
| 6,230,925 | B1 | 5/2001 | Hardigg et al. | |
| 6,234,364 | B1 | 5/2001 | Nybakke et al. | |
| D445,684 | S | 7/2001 | Key | |
| 6,257,440 | B1 | 7/2001 | Perkins et al. | |
| 6,269,977 | B1 | 8/2001 | Moore | |
| 6,293,692 | B1 | 9/2001 | Bowsher et al. | |
| 6,305,571 | B1 | 10/2001 | Chu | |
| RE37,518 | E | 1/2002 | Hardigg et al. | |
| 6,349,847 | B1 * | 2/2002 | Mangla et al. | 220/754 |
| D456,259 | S | 4/2002 | Groenewald | |
| 6,367,670 | B1 | 4/2002 | Warner et al. | |
| D458,844 | S | 6/2002 | Shea | |
| 6,398,076 | B1 | 6/2002 | Giblin et al. | |
| 6,412,661 | B1 | 7/2002 | Hannah, Sr. | |
| D467,813 | S | 12/2002 | Silvers et al. | |
| 6,494,341 | B1 | 12/2002 | Perkins et al. | |
| 6,500,380 | B1 | 12/2002 | Geisinger | |
| 6,517,230 | B1 | 2/2003 | Afnan et al. | |
| 6,530,500 | B1 | 3/2003 | Bravo et al. | |
| D474,115 | S | 5/2003 | Brock et al. | |
| D475,628 | S | 6/2003 | Walsh et al. | |
| 6,582,117 | B1 | 6/2003 | Rogers et al. | |
| 6,588,612 | B1 | 7/2003 | Dorn et al. | |
| D478,820 | S | 8/2003 | Walsh et al. | |
| D480,973 | S | 10/2003 | Nottingham et al. | |
| 6,634,525 | B1 * | 10/2003 | Bravo et al. | 222/143 |
| 2002/0030063 | A1 | 3/2002 | Leray et al. | |
| 2002/0195471 | A1 * | 12/2002 | Nottingham et al. | 222/570 |
| 2003/0102339 | A1 | 6/2003 | Walsh et al. | |
| 2003/0102340 | A1 | 6/2003 | Walsh et al. | |
| 2003/0111489 | A1 | 6/2003 | Bravo et al. | |
| 2003/0111497 | A1 | 6/2003 | Lukaris | |
| 2003/0121941 | A1 | 7/2003 | Walsh et al. | |

FOREIGN PATENT DOCUMENTS

| | | | |
|---|---|---|---|
| BE | 0563951 | | 1/1958 |
| CA | 495276 | | 8/1953 |
| CA | 2016036 | | 5/1991 |
| DE | 1106201 | | 5/1961 |
| DE | 2060993 | | 6/1972 |
| DE | 4035517 | | 5/1991 |
| DE | 4123513 | | 1/1993 |
| EP | 350142 | | 1/1990 |
| EP | 486107 | | 11/1991 |
| EP | 301986 | | 1/1992 |
| EP | 599028 | A2 * | 6/1994 |
| EP | 641676 | | 4/1999 |
| EP | 999979 | | 6/2002 |
| EP | 1009641 | | 6/2002 |
| EP | 960055 | | 5/2003 |
| FR | 1139993 | | 7/1957 |
| GB | 274542 | | 7/1927 |
| GB | 528486 | | 10/1940 |
| GB | 675281 | | 7/1952 |
| GB | 2 024 309 | A | 1/1980 |
| GB | 2091677 | | 8/1982 |
| GB | 2 095 214 | A | 9/1982 |
| GB | 2110637 | | 6/1983 |
| GB | 2166706 | | 5/1986 |
| GB | 2213459 | | 8/1989 |
| GB | 2225309 | | 5/1990 |
| GB | 2233627 | | 1/1991 |
| GB | 2237788 | | 5/1991 |
| GB | 2238304 | | 5/1991 |
| GB | 2251431 | | 3/1992 |
| GB | 2262929 | A * | 7/1993 |
| GB | 2284587 | A * | 6/1995 |
| JP | 52-136089 | | 11/1977 |
| JP | 55-134961 | | 10/1980 |
| JP | 59-132611 | | 7/1984 |
| JP | 60-089154 | | 6/1985 |
| JP | 60-240658 | | 11/1985 |
| JP | 61-93061 | | 5/1986 |
| JP | 61-185495 | | 8/1986 |
| JP | 62-151692 | | 7/1987 |
| JP | 63-500934 | | 4/1988 |
| JP | 63-126258 | | 8/1988 |
| JP | 04-062653 | | 5/1992 |
| JP | 8-309173 | | 11/1996 |
| JP | 11-226375 | | 8/1999 |
| WO | WO92/06013 | | 4/1992 |
| WO | WO 93/02928 | | 2/1993 |
| WO | WO 02/085713 | | 10/2002 |
| WO | WO 03/047881 | | 6/2003 |

OTHER PUBLICATIONS

D. Peloux, *Avi Annonce La Couleur*, Emballages, Nov. 1990, at 17 (Cie fran, cais d' editions; Paris).

*Thinking Out Of The Tin Creates Great Paint*, Packaging News, May 2003 at 12 (Maclean-Hunter; London).

Gail Underwood, *Printed Pails Compete For Attention*, Packaging News, Feb. 1990, at 29 (Macclean-Hunter; London).

Robert Eller, *The Plastic Paint Container: Has Its Time Finally Come?*, Modern Paint and Coatings, Oct. 1983, at 177 (Palmerton Pub. Co.; Atlanta).

B. van bedaf, *Solid Paint Container Is World First*, Packaging News, May 1985, at 24 (Surry Hills, N.S.W. : Yaffa Pub. Group).

*Container Stands By its Design*, Packaging Week, Nov. 7, 1990, at 25 (Benn Publications Ltd.; Tonbridge, Kent).

*Bristling With New Ideas*, Packaging Week, Nov. 7, 1990, at 21 (Benn Publications Ltds.; Tonbridge, Kent).

*Developments In Paint Packaging*, European Polymers Paint Colour Journal, Mar. 20, 1991, at 153 (FMJ International Publications; Redhill, Surrey, England).

*Confident Approach At RPC*, Packaging Week, Jun. 19, 1991, at 16 (Benn Publications Ltd.; Tonbridge, Kent).

*Marktgerechtes Verpackungsdesign*, VR Verpackungs-Rundschau, Jun. 1991, at 688 (Heunsenstamm, P. Keppler Verlag KG).

H. Thompson, *Infinite Uses Of Sleeving*, Packaging Week, Jun. 26, 1991, at 28 (Benn Publications Ltd.; Tonbridge, Kent).
David Greenfield, *Manufacturers Keeping Pace With Paint Container Market*, Modern Paint and Coatings, Feb. 1992, at 28 (Palmerton Pub. Co.; Atlanta).
Stafford Cliff, *Les Sensations*, The Best in Specialist Packaging Design, 1993, 4 pages (B.T. Batsford Ltd; London).
Jane Weatherley, *Breating New Life Into Old Favourites*, Packing Week, Oct. 13, 1994, at 20.
R. Leaversuch, *See-Through Plastic Cans Enliven Paint Packaging*, Plastics Technology, Aug. 2001, at 45 (Gardner Publications; Cincinnati, Ohio).
Anne and Henry Emblem, *Design Fundamentals: Packaging 2 Protypes*, 2000, at 22-24, 46, 51, 69, 108 (Roto Viston SA; Switzerland).
Cathy Bond, *Paints Packed with Punch*, Marketing, May 18, 1995, at 25 (Haymarket Publishing LTD; London).
Abstract of the following article: R. Pidgeon, *Dulux Relaunches Paint in a User Friendly Can*, Packaging Week, Jan. 20, 1993, at 6.
Abstract of the following article: F. McWilliam, *Reed Moves Into PET With Paint Container*, Packaging Week, Jan. 3-10, 1990, at 1.
Abstract of the following article: Anon, *Crown Claims First for Paint Packaging*, Packaging Week, Sep. 27, 1989, at 11.
Abstract of the following article: Anon, *New Look Paint: New PET Paint Cans from Dulux*, Packaging Innovation, Mar. 2003, at 1.
Abstract of the following article: M. Urry, *Crown: Cleaning Up in the UK Paint Market*, Financial Times, Jan. 4, 1990, at 8.
Abstract of the following article: Anon, *Closure and Spout*, Can. Packag., Dec. 1994, at 35.
Maggie Urry, *Packaging—Crown; Cleaning Up in the UK Paint Market*, Finanical Times, Jan. 4, 1990, at 8 (The Financial Times Ltd., London).
David Greenfield, *Manufacturers Keeping Pace with Paint Container Market*, Modern Paint and Coatings, Feb. 1992, at 28 (Communications Channels Inc.).
W. Guise, *Polypropylene in Packaging*, Packaging, Apr. 1993, at 4 (Turret Group, UK).
Flambeau 2004 Spring Buying Guide (17 pages).
Photograph of a Flambeau Handle (1 page).
International Search Report and Written Opinion for Application No. PCT/US2004/021908, mailed Mar. 30, 2005, 10 pages.

* cited by examiner

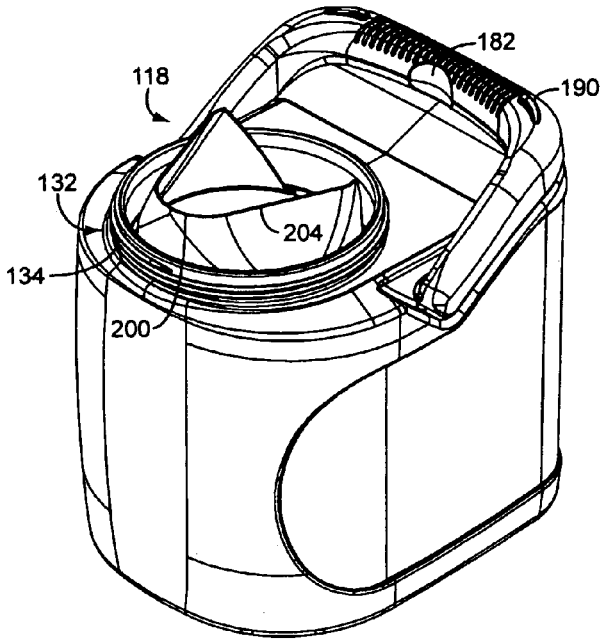
FIG. 16
FIG. 17
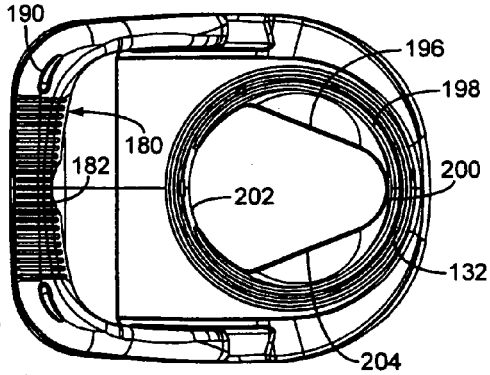
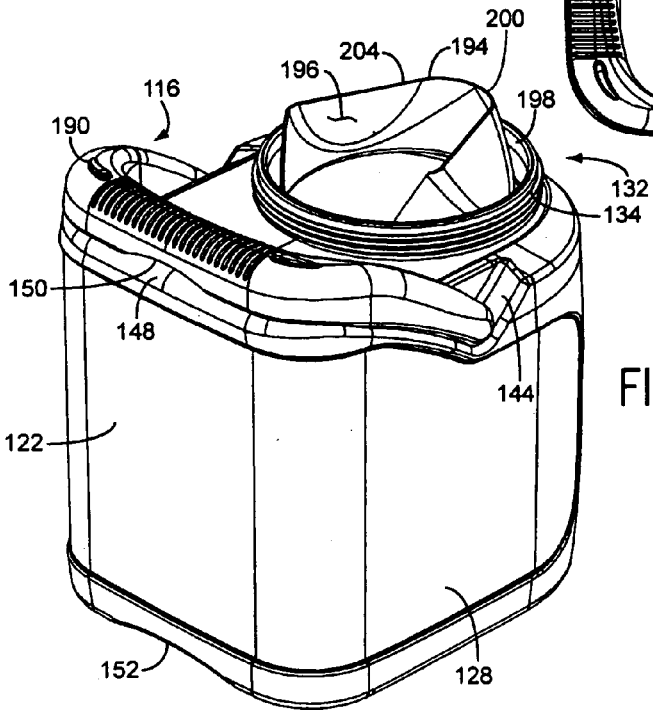
FIG. 15

CONTAINER

CROSS-REFERENCE TO RELATED PATENT APPLICATIONS

This application is a continuation-in-part of U.S. patent application Ser. No. 10/132,682 filed Apr. 25, 2002 now U.S. Pat. No. 7,014,078 entitled Container and incorporated herein by reference, which is a continuation-in part of U.S. patent application Ser. No. 10/006,985 filed Dec. 5, 2001 now U.S. Pat. No. 7,036,693 entitled Paint Container, which is incorporated herein by reference.

BACKGROUND OF THE INVENTION

The present invention relates generally to the field of containers and more specifically a container for the distribution, sale, and use of paint.

Typically, paint for application to a house or building for both interior and exterior applications is sold in a cylindrical one gallon metal container. The metal container includes a round base and a cylindrical side wall attached to and extending from the base. The side wall terminates in an upper rim or chime having a u-shaped channel that frictionally receives and engages a plug or lid having a downwardly extending u-shaped annular ring that is frictionally engaged by the walls of the u-shaped channel.

The lid of a conventional paint container is removed by prying the annular ring out of the channel. This is accomplished by using a lever between an outer upper edge of the cylinder and the outer edge of the lid. In order to ensure that the lid does not fall off of the container, the interference/friction fit between the annular ring of the lid and the u-shaped channel of the container is sufficient to require the use of tools to remove the lid. Accordingly, a lever such as a screwdriver is used to pry the lid off of the upper rim by using the edge of the side wall as a fulcrum to apply sufficient force to the outer edge of the lid to remove the annular ring form the u-shaped channel. Depending on the amount of friction that must be overcome, a user usually has to apply pressure at a number of points about the circumference of the lid and container. The repeated insertion of the lever may result in damage to the lid or the coating on the inner surface of the metal lid that is intended to prevent rust or contamination of the paint.

The paint may be poured from the container into a tray or other smaller container to be used by the painter to apply the paint to the intended surface either by brush, pad, roller or other mechanical or electrical system. Almost any time paint is poured, paint drips down the outside of the cylindrical wall and covers any identifying label. If the drips are significant, the paint may streak down the outer edge of the cylindrical wall and drip to the supporting surface that the paint container has been placed on. In any event, a certain amount of paint will be trapped within the u-shaped annular ring of the upper edge of the cylindrical side wall.

When the lid is placed back onto the top of the container, the downwardly extending unshaped ring on the lid will be soiled by the paint in the annular receiving area of the cylindrical wall. This creates a potential problem the next time the lid is removed and placed on a supporting surface. The paint on the annular surface may soil the surface upon which the paint lid rests or the hands of the user when they replace the lid again after use. If latex paint is in the container then the latex may dry in the channel and act as an adhesive between the lid and container making subsequent removal of the lid more difficult. The dried paint in the channel may prevent an air tight seal as result of paint buildup preventing the lid from being fully seated within the channel. Further, paint trapped in the channel may be splattered about the room when the lid is replaced and the trapped paint will likely spill over the edge and streak down the side of the container.

Additionally, if the can itself is used as the container from which a brush is dipped by the painter, a significant amount of paint will accumulate in the channel as the brush is removed and excess paint is wiped against the edge of the can. Further, the inner annular edge of the container channel makes it difficult to uniformly wipe paint off of the brush. This results in an uneven application of paint on the brush and on the surface to be painted.

Further the cylindrical container provides other disadvantages in the shipping, display and handling of the container by the end user. First, since the containers are round, the area between the cans represents wasted space when the container are shipped from the factory to the retail outlet. This wasted space must be paid for in terms of shipping costs. Similarly, shelf space at the retail outlet is wasted by the area between the cans. Since the cans are cylindrical, the label must also be cylindrical and therefore does not present the ideal display surface for the consumer at the retail outlet. As the consumer typically walks down the isle, the customer views the container at an angle which reveals only a portion of the label. Many display shelves also permit more than one can to be stacked in a front to back fashion. The cylindrical shape also limits the number of rows of cans that may be stacked on a display shelf.

The handle of the typical paint container is a thin curved wire member comprised of a 0.105 gauge material that digs into the user's hand under the weight of the paint and the container. It is difficult to carry more than one paint container in each hand utilizing the curved wire. Additionally, the curved wire handle requires handle pivot or "ear" supports to be added to the outer surface of the cylindrical can. These pivot supports add assembly and material costs to the container. The pivot supports further affect how the containers must be packed for shipping and for display. Since the pivot supports extend outward from the container, additional space between products or placement such that the pivot supports are in the "dead" space zone between the containers is required.

The cylindrical paint can does not provide a surface to support a paint brush. In order to balance a paint brush on the open container, the brush must be supported by two points on the outer lip. This is most easily accomplished with the bristles balanced at one point and the ferrule or handle balanced at another point. As discussed above, paint often collects in the channel of the container resulting in the ferrule or handle being soiled. Alternatively, if the channel does not contain paint, the placement of the bristles on the edge of the container will likely result in paint dripping into the channel and/or on to the edge of the container, which will likely soil the ferrule or handle if the ferrule or handle is subsequently placed on the soiled region.

Paint that falls into the channel also presents a problem when the lid is being secured to the container after use. The paint in the channel is forced out of the channel as the annular ring of the lid is being located into the channel. Unless the lid is covered, the paint in the channel will splatter about the room as the lid is securely attached to the container. This result is due to the fact that the lid must be fully seated within the channel and a significant force is required. Typically a rubber mallet is used and the lid is struck a number of times with significant force.

Another problem with the existing paint container is that if the paint is shaken in the container with the lid securely attached, the underside of the lid will become covered with paint and becomes difficult to handle when it is removed from the container.

From the foregoing, it would be desirable to provide a paint container that would minimize shipping costs and permit a maximum number of containers to be stacked on a retail outlet shelf per linear foot of display. It would be further desirable to provide a product and method for displaying a paint product that allows for non-curved labeling. It would be desirable to provide a container that must be positioned correctly on the shelf, and is not easily rotated to a position that makes it difficult for a consumer to see the label. Another feature that would be desirable is a container system that facilitates stacking the containers one in front of the other.

It would also be desirable to provide a container having a paint reclamation pouring mechanism in order to maintain a clean work area. It would also be desirable to provide a paint container that eliminates the need for handle supports or ears on the cylinder. It would also be desirable to provide a handle that is easy for the user to use and does not cut into the user's hand. Additionally, it would be desirable to provide a container with a lid that also serves as a paint container. It would still further be desirable to provide a lid that may be attached securely onto the container without the need for tools. It would also be desirable to provide a container with a spout that provides for a brush to be inserted into the container and includes a non-curved edge to provide for even wiping of the brush. It would also be desirable to provide a container that does not permanently dent when dropped or hit. It would also be desirable to provide secure surfaces for a container having one or more of the foregoing features to be employed in shaker equipment, to mix and or shake the paint. It would be desirable to provide a paint container with the foregoing features alone or in any combination.

SUMMARY OF THE INVENTION

An exemplary embodiment relates to a paint container. The paint container includes a top, a bottom, a substantially flat side wall and at least a second side wall connected to the first side wall. A handle is pivotally attached to the body proximate the top and having a recess adjacent the flat side wall. A finger recess is disposed in the bottom and an access recess is positioned between the bottom and at least one side wall. A user may insert one or more fingers through the access recess and into the finger recess to grasp the body when the body is resting on a flat surface.

Another embodiment relates to a pour spout for a paint container. The pour spout includes an outer wall, and an inner wall defining a reclamation channel between the inner wall and the outer wall. A flange extends from the inner wall having a wiping edge configured to remove paint from a paint brush.

A further embodiment relates to a paint container having a body with a top and a bottom surface. A handle is pivotally coupled to the body an includes tabs extending toward each other, the handle having an extended use position and a retracted rest position. A cap is configured to seal an aperture in the body, the cap extending upwardly from the top, the cap having a surface portion parallel to the bottom support surface defining an apex height. The handle in the rest position has a handle surface at the apex height and no portion of the body extends upwardly to a position greater than the apex height. Another embodiment provides a handle including a center portion having a top surface and a varied region projecting from the top surface and offset from a center of the center portion, and the bottom including a support surface configured to contact a portion of the top surface, the support surface configured including a recess configured to receive a varied region of a second container.

A still further embodiment relates to a method of mixing paint in a paint container. The method includes the steps of providing a plastic paint container having a planar top surface and a planar bottom surface, wherein the top surface and the bottom surface are parallel. Further steps include providing paint in the plastic paint container, providing a paint mixing machine having a support surface and a compression surface, and placing the bottom surface onto the support surface. Further steps include securing the paint container between the support surface and the compression surface and mixing the paint by agitating the container with the paint mixing machine.

In another embodiment, a container includes body having a first side with a substantially flat portion, and an opposing curved side. A pour spout is proximate the curved side and a handle is pivotally attached to the body, having a resting position adjacent the first side.

Alternative exemplary embodiments relate to other features and combinations of features as may be generally recited in the claims.

BRIEF DESCRIPTION OF THE DRAWINGS

FIG. 15 is a perspective view of the container in FIG. 11 without the cap.

FIG. 16 is a rear perspective view of the container without the cap.

FIG. 17 is a top view of the container without the cap.

FIG. 19 rear view of the container with a partial detail cross-sectional view.

DETAILED DESCRIPTION OF THE PREFERRED EMBODIMENTS

Figure 1:
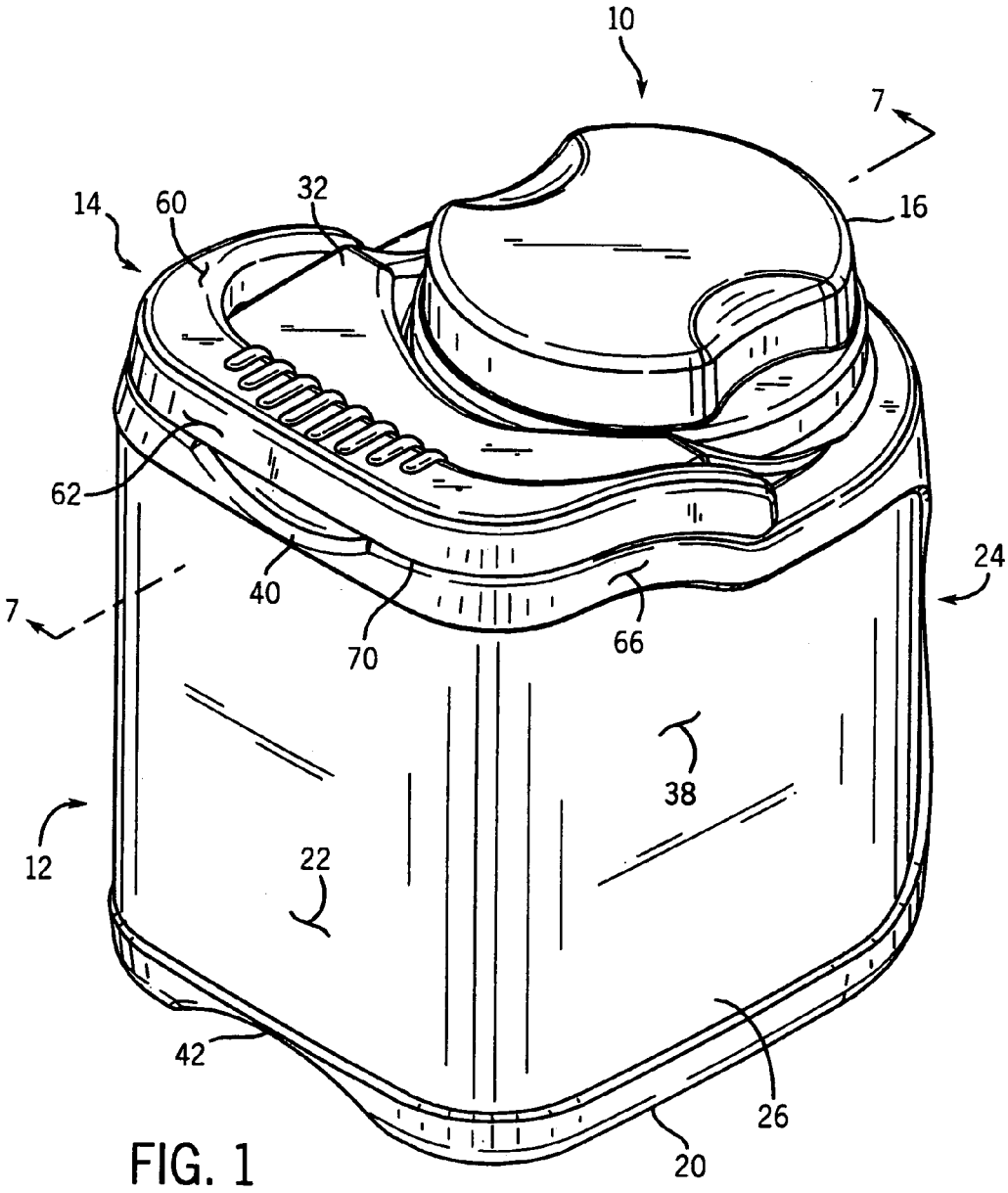
FIG. 1 is a perspective view of a paint container.
Figure 2:
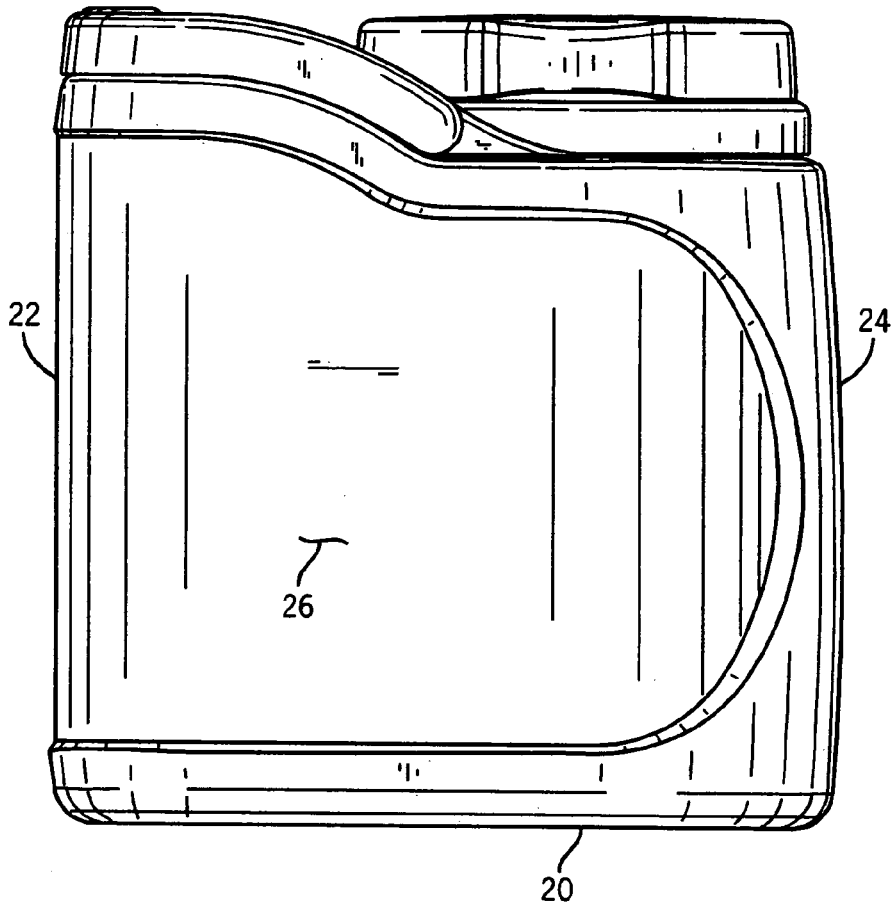
FIG. 2 is a side view of the paint container of FIG. 1.
Figure 9:
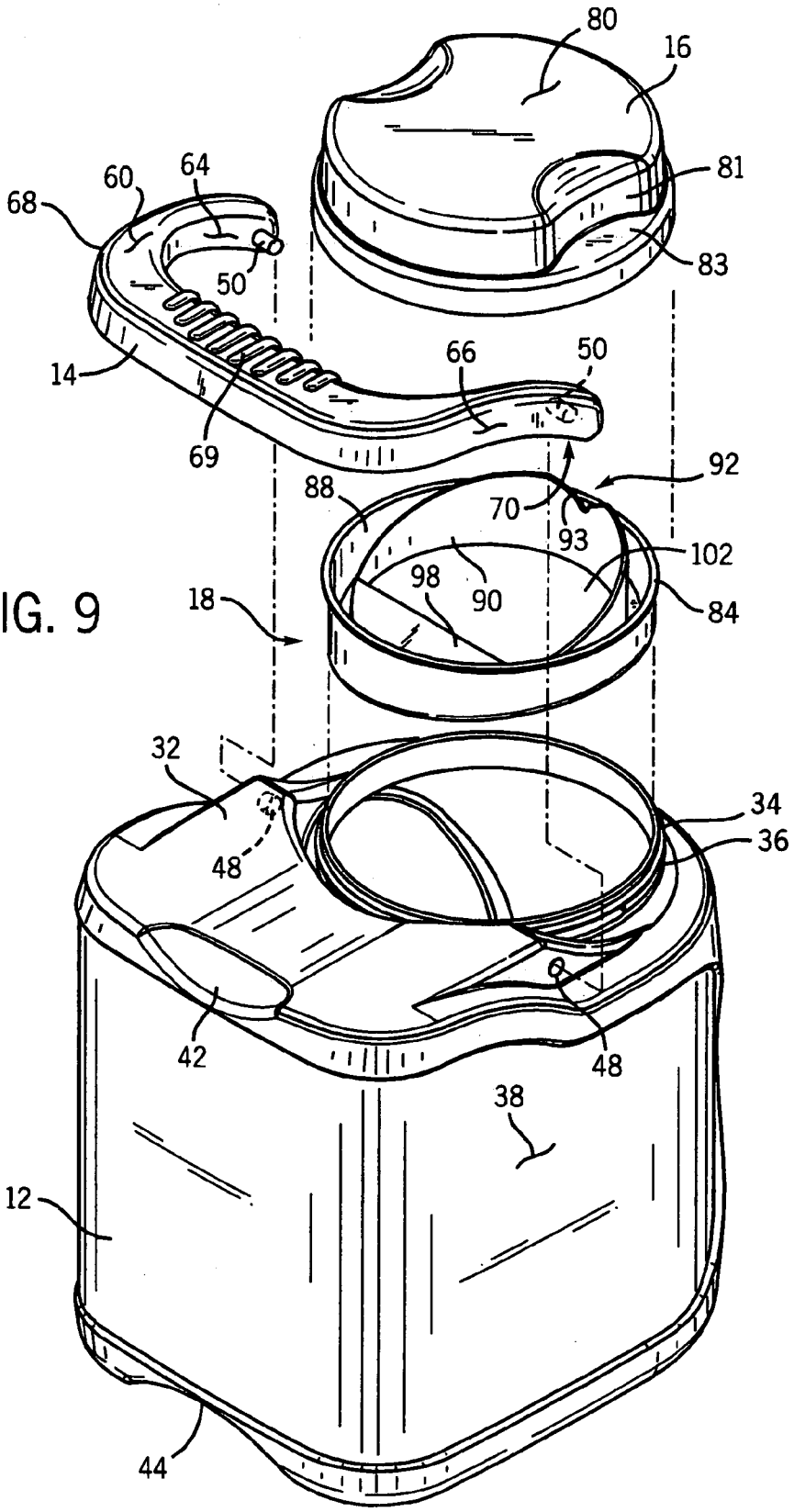
FIG. 9 is an exploded view of the paint container.
Figure 10:
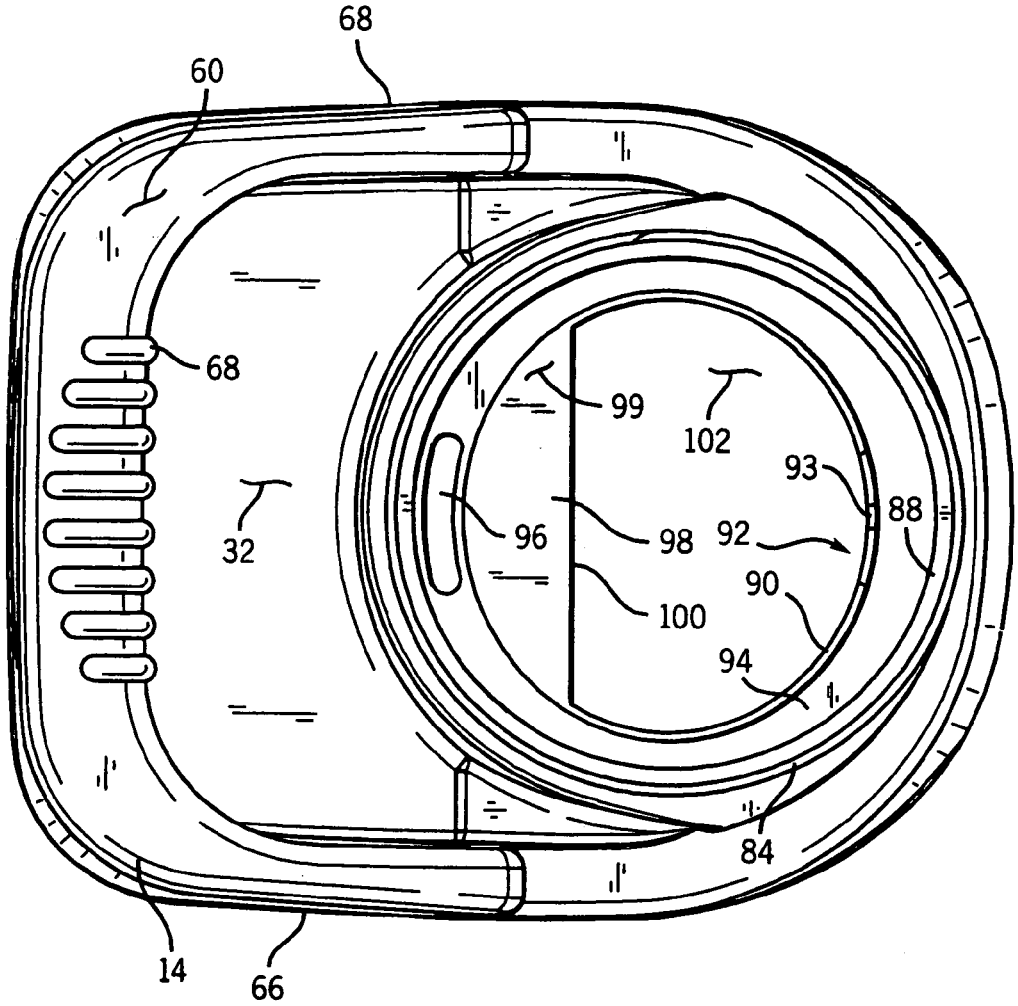
FIG. 10 is a top view of the paint container without the cap.

Referring to FIG. 1 and FIG. 9, a paint container 10 includes a body 12, a handle 14, a cap or cover 16, and a pour spout insert 18. Referring to FIGS. 1–6, body 12 has a general D-shape configuration and includes a bottom 20, a front wall 22, a back wall 24, and a pair of opposing side walls 26, 28. Additionally, body 12 includes a top 30 having a land region 32 and a neck 34 with external threads 36 to secure the cap 16. In one embodiment, container 10 is formed from a plastic material that may be injection molded, blow molded, or injection blow molded. The container may be formed from any other method known in the art.

Body 12, includes a recessed region 38 that extends across the front wall 22, the side walls 26, 28 and a portion of the curved back wall 24. The recessed region 38 may receive a label that could be applied during the forming operation such as in the mold, or a label may be affixed to the container after the container has been formed.

Figure 3:
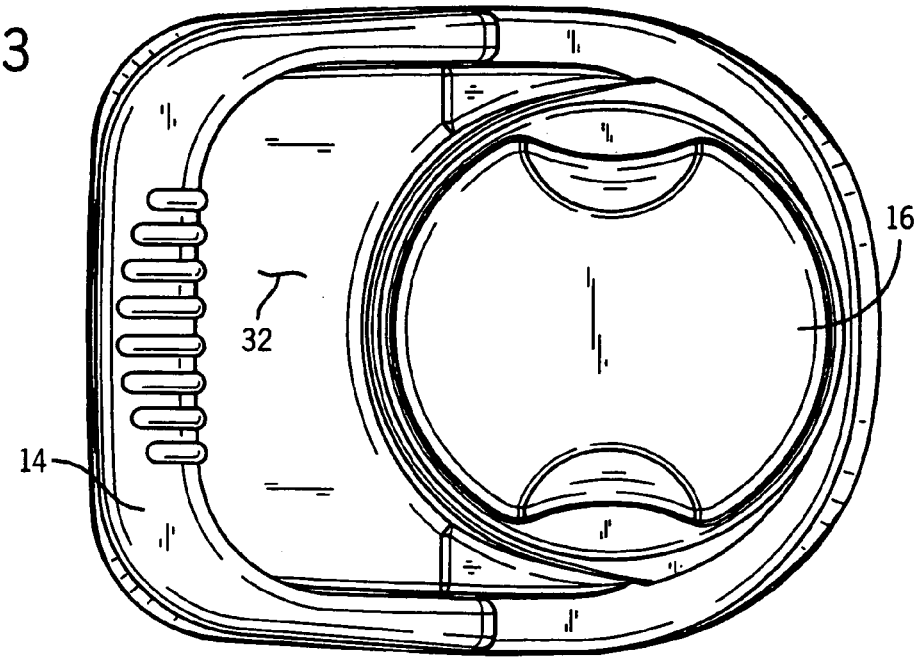
FIG. 3 is a top view of the paint container.
Figure 4:
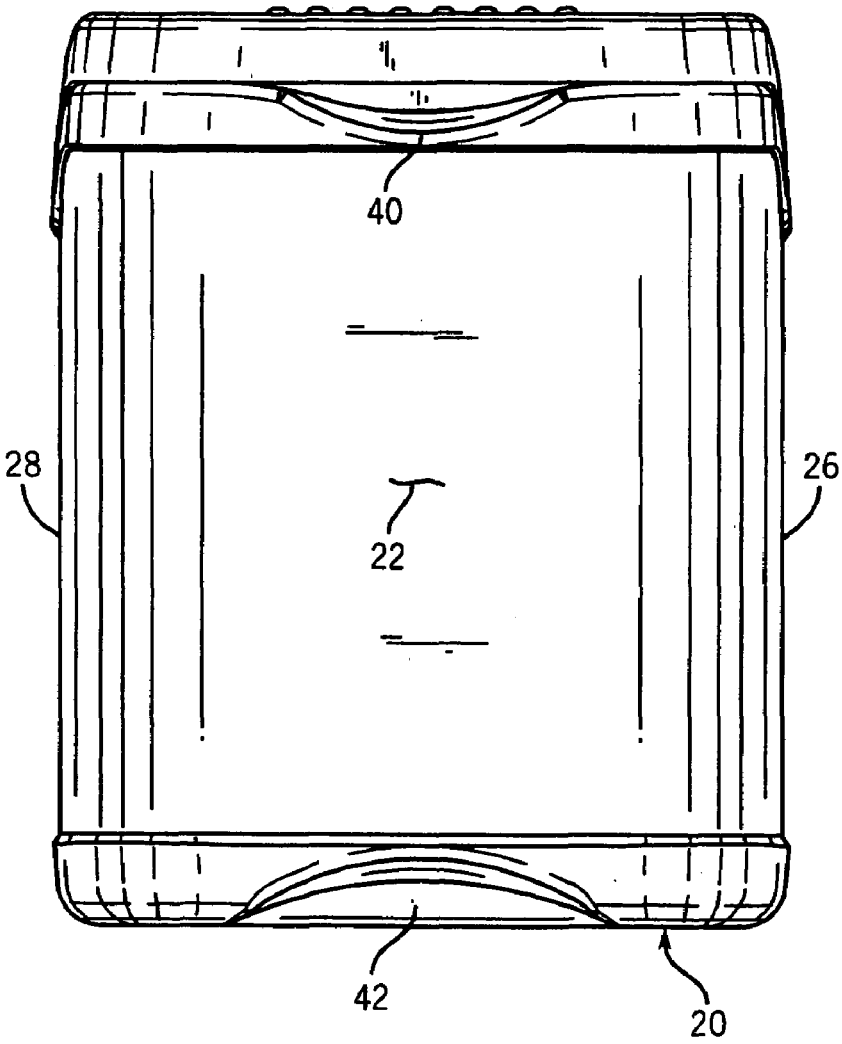
FIG. 4 is a front view of the paint container.
Figure 5:
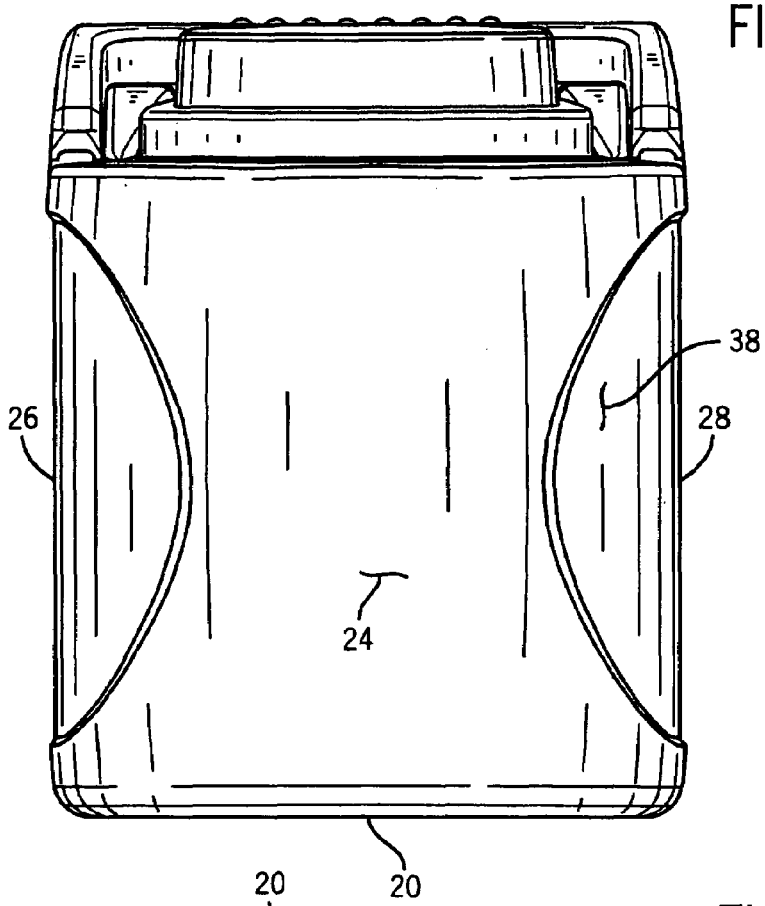
FIG. 5 is a front view of the paint container.
Figure 6:
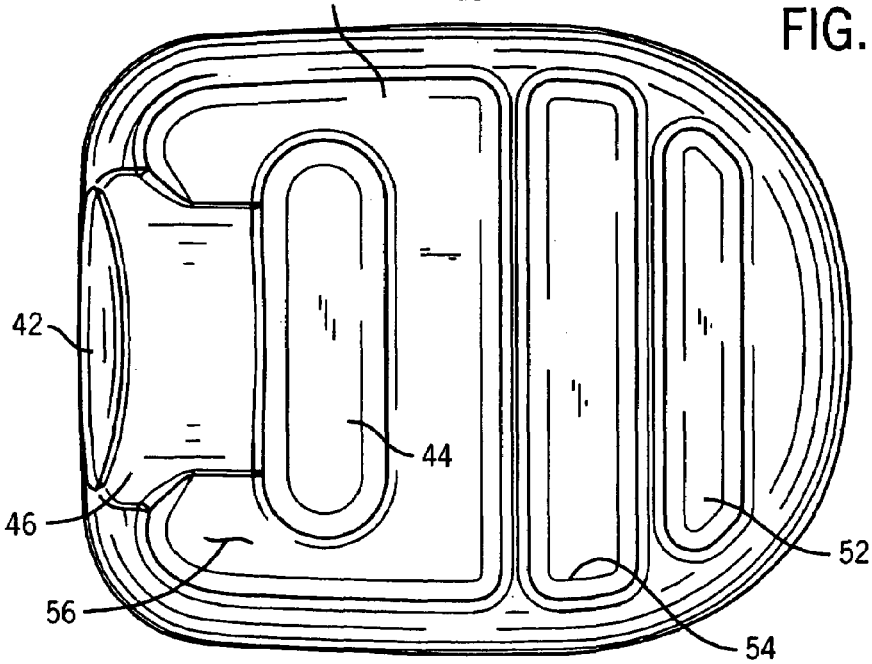
FIG. 6 is a bottom view of the paint container.

Body 12 further includes a first hand or top recess 40 located on the top edge of the container between the front wall 12 and the top 30. Top recess 40 enables a user to easily access the handle 14 when the handle 14 is in a first or rest position adjacent the top 30. A user can easily raise the handle 14 by simply sliding his or her hand within the recess under handle 14. The top recess 40 may be fully covered by the handle 14 on the top of the container as illustrated in FIG. 3, or the recess may be accessible from the top of the container when the handle is in the rest position. This would allow a user to reach under the handle from either the front of the container or from the top of the container.

A second hand or bottom recess 42 is located on the bottom edge of the container between the front wall 12 and the bottom 20. The bottom or access recess 42 allows a user to reach under the bottom 20 of the container 10 while the container is resting on a supporting surface. The bottom recess 42 further facilitates pouring paint from the container. The bottom recess 42 is connected to a finger recess 44 via channel 46 on the bottom 20 of the container. The finger recess 44 allows a user to insert his or her fingers into the recess 44 to provide support for pouring paint from the container in combination with handle 14. Additionally, the height of the bottom recess 42 and channel 46 as measured from a supporting surface may be sufficient to allow a user to insert his or her fingers in the finger recess 44 while the container is on the support surface. This would aid in pulling a container off of the support surface or off of a lower container where the containers were stacked.

Land 32 includes a pair of recess openings 48 to receive a pair of tabs 50 on handle 14. Of course land 32 could include tabs that would be received in apertures located in the handle 14. The tabs and apertures allow the handle 14 to pivot about the land from the rest position to a carrying position or intermediate pouring position. Other mechanical fastening structures that are know in the art may also be employed. Additionally, a snap in feature that releasably locks the handle 14 in the rest or in use position may be helpful to ensure the handle does not move. The snap or lock feature may be accomplished by irregular geometry of the handle tabs and land apertures, or any other known means for securing a handle in specific position relative to the container.

The bottom 20 further includes additional recesses 52, 54 to provide structural rigidity to the container. The recesses 52 and finger recess 44 extend into the container. The geometry of the recesses 52 should be such that a user can still access the paint on the inside of the container with a brush. The spaces between the recesses 44 and 52 should be sufficient to allow a user to access the paint between the resulting raised areas with a brush. The recesses may also be constructed to permit a top to bottom nesting feature with an adjacent stacked container. The bottom 20 also includes an outer periphery 56 that defines a plane that is parallel with the top of the cap 16 and top of the handle 14 for use in a compression type mixing apparatus. The portions 58 between the recesses 44, 52 and 54 are in the same plane as the periphery 56 to provide additional support for the container.

Handle 14 includes a top surface 60, a front surface 62, a rear surface 64, and a pair of opposing side surfaces 66, 68. When the handle 14 is in the rest position, the front and side surfaces 62, 66 and 68 are flush with the upper portion of the body. The handle may include a soft raised portion 69 that may be molded into the top surface 60 of the handle 14. The handle 14 includes a lower contour 70 that substantially follows the contour of the land 32 and upper portion of the body 12.

Figure 7:
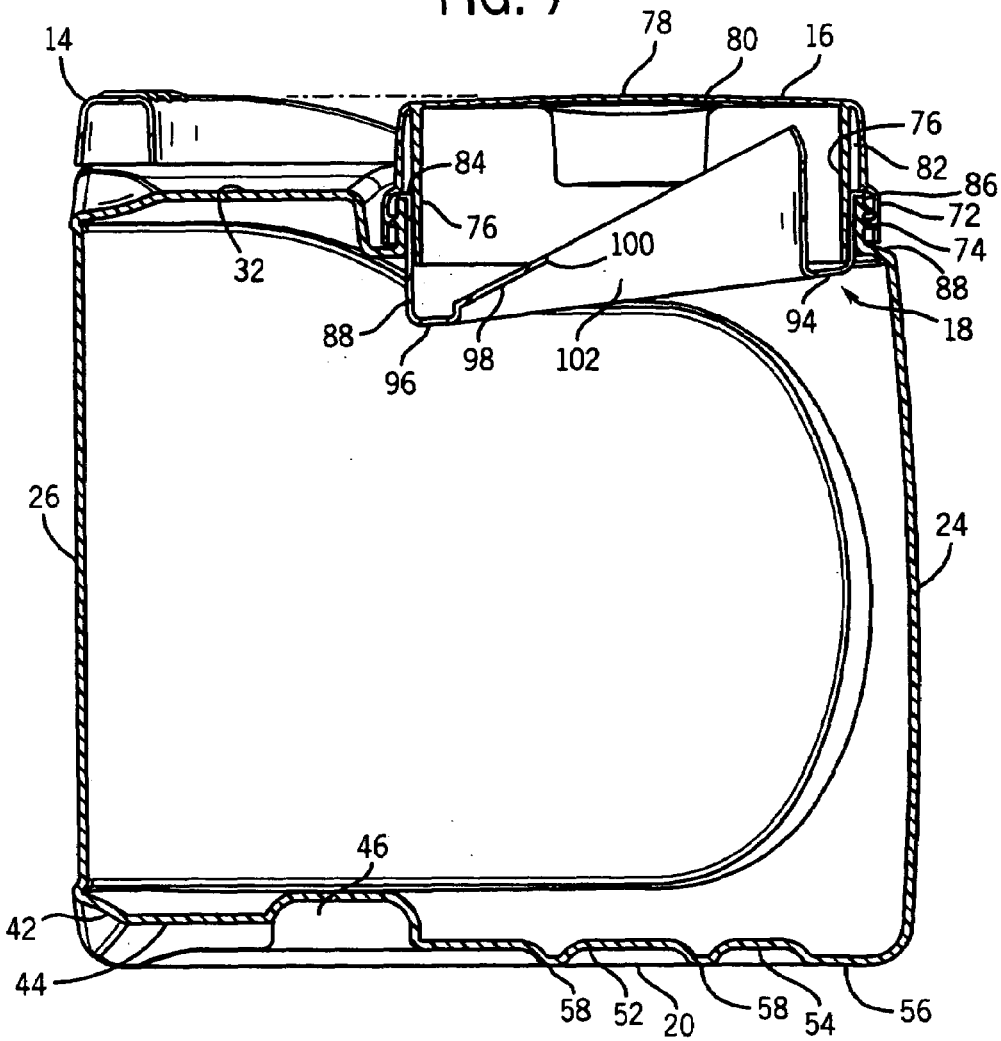
FIG. 7 is a cross-sectional view of the paint container taken generally along lines 7—7 of FIG. 1.
Figure 8:
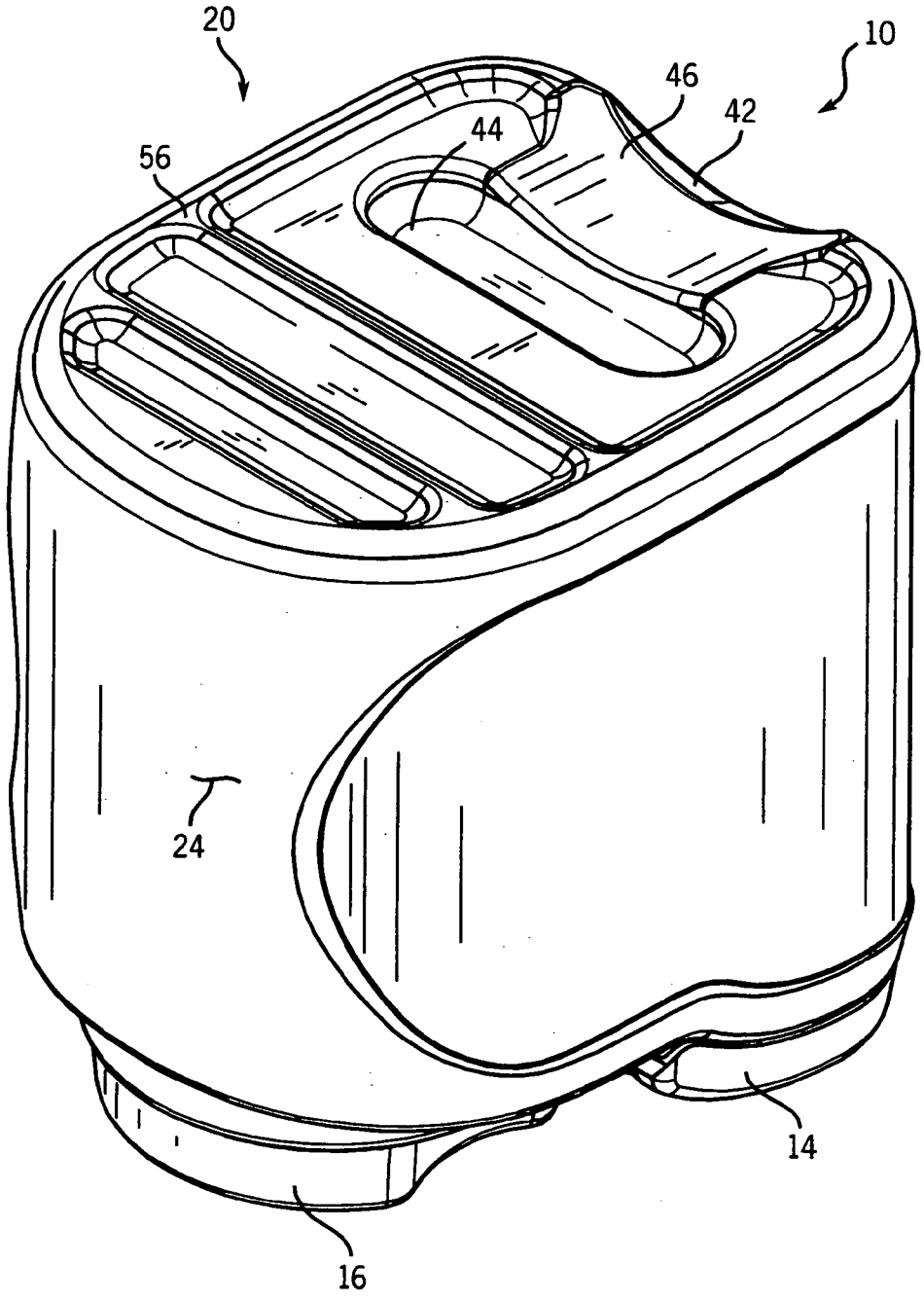
FIG. 8 is bottom perspective view of the paint container.

As illustrated in FIGS. 7 and 9, cap 14 includes an outer wall 72 with inner threads 74 that allow the cap 14 to be threaded onto threads 36 of neck 34. Cap 14 further includes an inner wall 76 extending from cap top 78 a distance greater than the distance that the outer wall 72 extends from the cap top 78. Outer wall 72 includes a compression surface 80 that engages the top portion of neck 34 to seal the cap to the container. As the cap 14 is threaded onto the neck 34, the inner wall 76 extends into the neck area of the container. Cap 14 further includes finger recesses 81 to facilitate closing and opening of the cap as well as holding the cap when the cap is being used as a paint dish. The top surface of cap 80 includes a substantially planar surface portion to enable the top to rest on a support surface to serve as a paint dish. Alternatively, the top of the cap includes geometry that enables the cap to rest on a support surface in a stable manner. This geometry could include a raised peripheral region. Finger recesses 81 form a land area 83 that facilitates use of the cap as a paint dish, since the land area allows for easy handling of the cap. Other embodiments of the cap could also be employed. For example, the cap could include more than two finger recesses or could include a knurled outer surface to help facilitate tightening the cap onto the body or removing the cap from the body. Further the cap could be ergonomically designed to conform to the palm of a user's hand when the cap is being used as a paint dish.

The use of an inner wall 76 and outer wall 80 allows the cap to be used as a paint dish without the paint soiling the threads of the container, or dripping paint on to the outside of the body when the cap is secured to the body after it has been used as a container. Since the inner wall 76 extends beyond the outer wall, any paint that drips out of the cap when the cap is secured to the container will drip directly into the container. Additionally, any paint that drips into the channel 82 between the inner wall 76 and outer wall 72 will drip into the container between inner wall 76 and the spout insert 18.

The spout insert 18 includes an outer lip 84 that rests on the top rim 86 of the neck 34 of the body 12. Insert 18 is secured to the body 12 by either an adhesive, friction fit, welding, or any other method known in the art. Insert includes an outer wall 88 and an inner wall 90 that includes a spout 92. In one embodiment spout 92 extends upward above the outer lip 84 of the outer wall 88. Spout 92 includes a "v" shaped recess with a circular recess 93 at the bottom portion of the "v". Insert 18 includes an angled floor 94 connecting the inner wall 90 ad outer wall 88. Floor 94 is angled downward from the rear wall 92 of the body and "v" region of the spout 92 toward the front wall 26 of the body 12. Other spout configurations may also be employed. For example the shape of the spout recess could be a shape other than a "v" shape. The recess could be "U" shaped or rectangular. Alternatively, the spout could not include a recess portion at all but rather the spout could extend toward a single apex, where the apex is the highest of the spout and the paint is guided to pour over the apex.

A channel 96 is formed between the inner wall 90, and outer wall 88. The angled floor 94 includes an opening 96 to connect the channel 96 with the interior of the container, to permit paint that drips over spout 92 to be reclaimed into the container via opening 96.

Insert 18 also includes a raised wipe portion 98 terminating in a straight edge 100. The raised wipe portion 98 extends from the inner wall 90 into the opening 102 defined by the inner wall 98 and the straight edge 100 of the wiper portion 98. The angle of the wipe potion 98 allows for reclamation of paint back into the container if the paint drips onto the top portion 99 of the wipe portion 98. In one embodiment the opening 102 has a diameter of three and one half inches, allowing for easy insertion of a three inch brush. The straight edge has a width of at least three inches to permit the brush to be wiped along straight edge 100 without curving the bristles. It is possible to replace the straight edge with a comb or undulated edge feature. It is also contemplated that a comb feature could be releasably attached to the raised wipe portion to provide another type of wiping edge geometry if desired. The geometry of the opening 102 may be modified to allow for a larger or smaller brush width to enter the interior of the container to apply paint to a brush. For example the opening could be four inches or greater to allow for a four inch brush to be inserted.

The "D" shape of the container allows for a convenient curved rear surface over which the paint is poured, and a substantially straight rear surface to allow for a label having a flat surface to be applied. The flat surface permits easier viewing of the label on the store shelf for the consumer. If the front of the container with the flat surface is facing the isle, the consumer can easily pick up the container by using both the handle 14 and the bottom finger recess 44 through recess 42 and channel 46 as discussed above. The curved rear surface guides the paint toward the spout 92 aiding in the removal of the last portion of paint in the container.

The cap 16 is easily removed both in the retail outlet for easy tinting and at home or on the job site without requiring additional tools. Once the tinting coloring has been added the cap is screwed back on to the body of the container such that the top of the cap and the top surface of the handle are in the same plane. Since the top surface of the handle and cap are in a plane parallel to the button supporting surface, the paint in the container can then be mixed utilizing a standard mixing apparatus where the top and bottom of the container is trapped and compressed between two surfaces and subsequently shaken. The surface area of the handle and cap provide a stable surface for this type of compression apparatus. The container may employ other geometry to ensure that the container may be securely located in a compression type mixer. The mixer itself could employ a top member that matches the profile of the top of the container including the handle and cap. The container, cap and/or handle could include raised features to permit the top member of the mixer to effectively clamp onto the container for mixing.

The geometry of the body facilitates access to the paint, once the level of paint drops. Since the recess 42, channel 44 and finger recess 46 protrude into the interior of the container a greater amount than recesses 52 and 54, a greater amount of paint will be in the region directly below the opening 102 to facilitate removal of the paint from the bottom of the container. Additionally, curved portion of the back wall 24 focuses the last amount of paint in a single area proximate the spout 92, when the paint is being poured from the container.

The container may also include features to promote stacking of the container. For example, the container may include four small bumps on the bottom periphery that would act as feet and interlocking features with structure on the top of the container. For example, the top of the container could include four small indents that would receive the bumps, or the bumps could be restrained from moving in a lateral direction by four offset guides. Of course there could be more or less than four locating features. Additionally, any locating feature could be arranged such that there is no impediment form sliding an upper stacked container off of a lower stacked container, by having the rear portion of the guides open. The raised portion or bumps could also be located on the top of the container and the recess or guides be located on the bottom of the container. The bumps could also be flexible such that they would be resiliently deflected when the container is clamped in a paint mixer that clamps the container on the top and bottom.

Turning now to an other embodiment illustrated in FIGS. 11–21, a container 110 includes a body 112, a cap 114, a handle 116, and a spout 118. Body 112 includes a bottom 120, a front wall 122, an opposing rear wall 124; and first and second side walls 126, 128. Body 112 also includes a top 130 having a neck 132 provided with external threads 134. The use of the terms front and rear refer to the position that the container may be placed on a retail shelf. While the container may be placed on the retail shelf in any orientation, the front wall 122 provides a planar surface for a display label. While in actual use of the location of spout 118 may be considered the front, however for purposes of this description spout 118 is closer to back wall 124.

Top 130 also includes a first land region 136 proximate the neck 132, a second angled transitional region 138 and an upper region 140 configured to support handle first region proximate. Land region 136 may be flat or parallel to a horizontal plane as illustrated or may have another profile. Adjacent sides 126, 128 and top 130 is a pair of handle support regions 142 that begin lower than first land region 136 and angle upward to transition region 138 and upper region 140. Region 142 as measured from a vertical plane in one embodiment is preferably about 45 degrees. Additionally, a back handle support region 144 as described below supports handle 116 in a rearward position closer to spout 118. Back handle support region 144 as measured from a vertical plane is preferably about 60 degrees. The angle of support region in combination with the size of handle 116 prohibits handle 116 from contacting spout 116 or the rear portion of body 112, and still providing clearance over the cap 114 to lift the handle. Accordingly, other angles of region 144 may be used.

Body 12 also includes a recessed region 146 that extends across the substantially flat front wall 122 and around at least a portion of the curved back wall 124. Recessed region 146 may receive a label that could be applied during the forming operation such as in-mold labeling for a plastic formed component. A label may also be applied to the container after the container has been formed.

A front edge 148 of upper support region 140 may be curved or beveled as a transition into front wall 122. This transition edge 148 provides an easy surface for a user to be able to grasp handle 116. While the front edge 148 may have a recessed region permitting a user to slide his fingers under the handle, handle 116 may also include a handle recess 150 either in addition to a recess on the edge 148 or independent of such a recess. A disruption in the interface between handle 116 and the top 130 and front wall 122 allows a user to easily grasp and raise handle 116.

Figure 12:
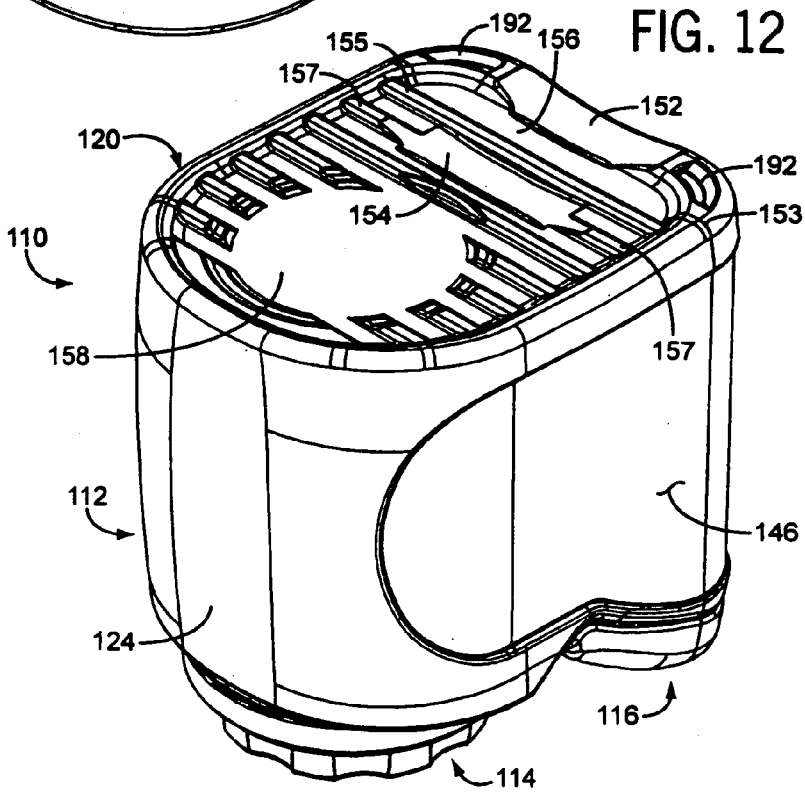
FIG. 12 is an inverted perspective view of the container of FIG. 11.

A bottom recess 152 is located on the bottom edge of the container between the front wall 122 and the bottom 120. Bottom recess allows a user to reach under the bottom of the container 110 while the container is resting on a supporting surface or on another container 110. Bottom recess 152 further facilitates pouring paint from the container. Bottom recess 152 is connected to a finger recess or well 154 extending inwardly into container 110 from bottom 120. Finger recess 154 may be located immediately proximate bottom recess 152 or may be connected to bottom recess 152 with a recess channel 156. The bottom recess 152, recess channel 156 and finger recess 154 may be configured to comfortably rest on a users hand to aid the user in pouring the content from the container. As shown in FIG. 12, bottom recess 152 abuts a periphery 153 of the bottom 120 and extends inward through channel or region 156. In the embodiment shown in FIG. 12, a structural rib 155 extends across the bottom 120. A finger recess 154 is located between rib portions 157 to provide a region to grasp the bottom of the container. While one hand is holding handle 116, a second handle may be grasping the bottom by use of the bottom recess 152, finger recess 154, and recess channel 156 either together or in any combination of these features. The rib 155 provides a support for the fingers to hold the container as the contents of the container is being poured.

The height of the bottom recess 152 as measured from a support surface of the container, or as measured from the lowest support features on the bottom 120 may be sufficient to allow a user to insert his fingers or portion of his finger in the bottom recess and/or channel recess and/or finger recess. This would allow a user in combination with the handle to easily lift the container from a support surface such as a retail outlet shelf, table or another container.

Bottom 120 includes a cap recess 158 configured to receive a portion of cap 114 when like container 110 are stacked on one another. Cap recess 158 may include a periphery having matching features as cap 114 such as indentations to match the recesses 159 on cap 114. Alternatively, cap recess 158 may have an outer diameter that matches or exceeds the outer diameter of cap 114.

Body 112 includes a pair of handle recesses 160 extending into handle support wall 162 adjacent first region 136 and support region 142. Handle recesses 160 receive a pair of trunnions or tabs 164 extending inwardly from handle 116. Of course, container 110 may include a pair of tabs extending outwardly that would be received within a pair of recesses on the handle 116. The tabs and aperture allow the handle 116 to pivot from a first rest position in which the handle 116 is proximate front wall 122 (See FIG. 11) to an in-use position (See FIG. 13) to a fully forward position in which handle 116 rests against handle support surface 144 (See FIG. 14). In a preferred embodiment, container 110 is blow molded from plastic. Recesses 160 have an opening configured to receive a respective trunnion. (See FIG. 19) As further described below, recess 160 has a non uniform cross section with the opening in the fore/aft direction being greater than opening in the up/down direction. The cross section is sized to receive trunnion 164 that is also of non-uniform cross section. The recess extends inwardly toward the interior of container body 112 and has a back wall 166 and an interior wall 168. As the handle is rotated from the rest position to the vertical and fully extended position, an extension portion 188 of the trunnions interfere with the interior wall 168. In another embodiment, the wall 168 of the recess 160 (see FIG. 22) in the container defines a groove 169 configured to receive an extension 188 defined on the trunnion (tab) 164 (see FIG. 22).

Figure 11:
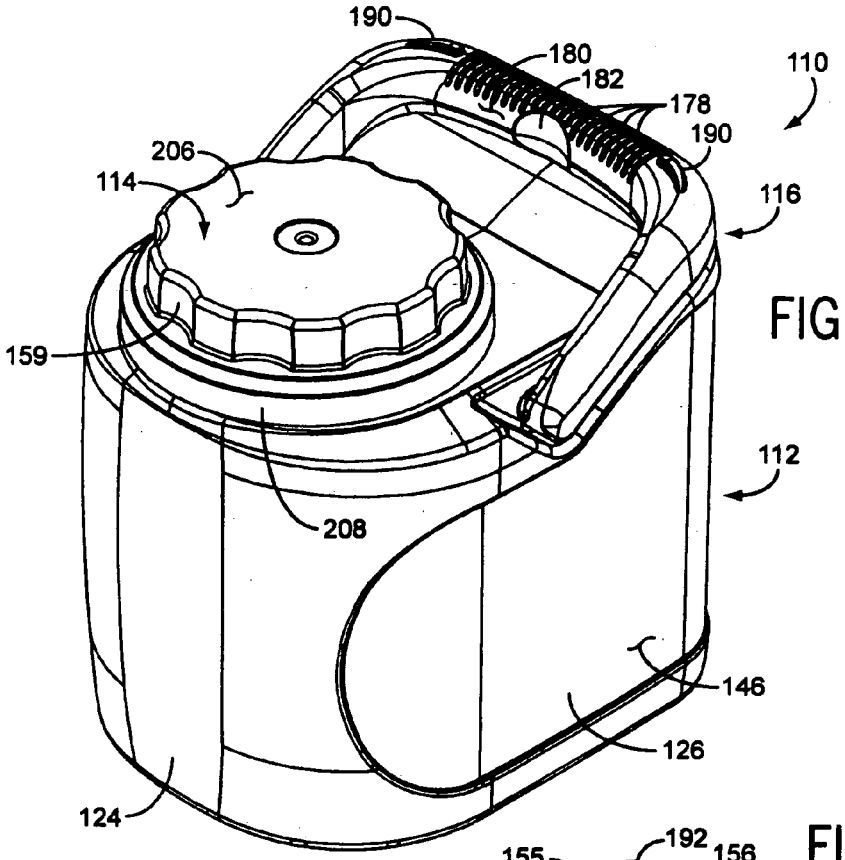
FIG. 11 is a perspective view of an alternative container embodiment.
Figure 13:
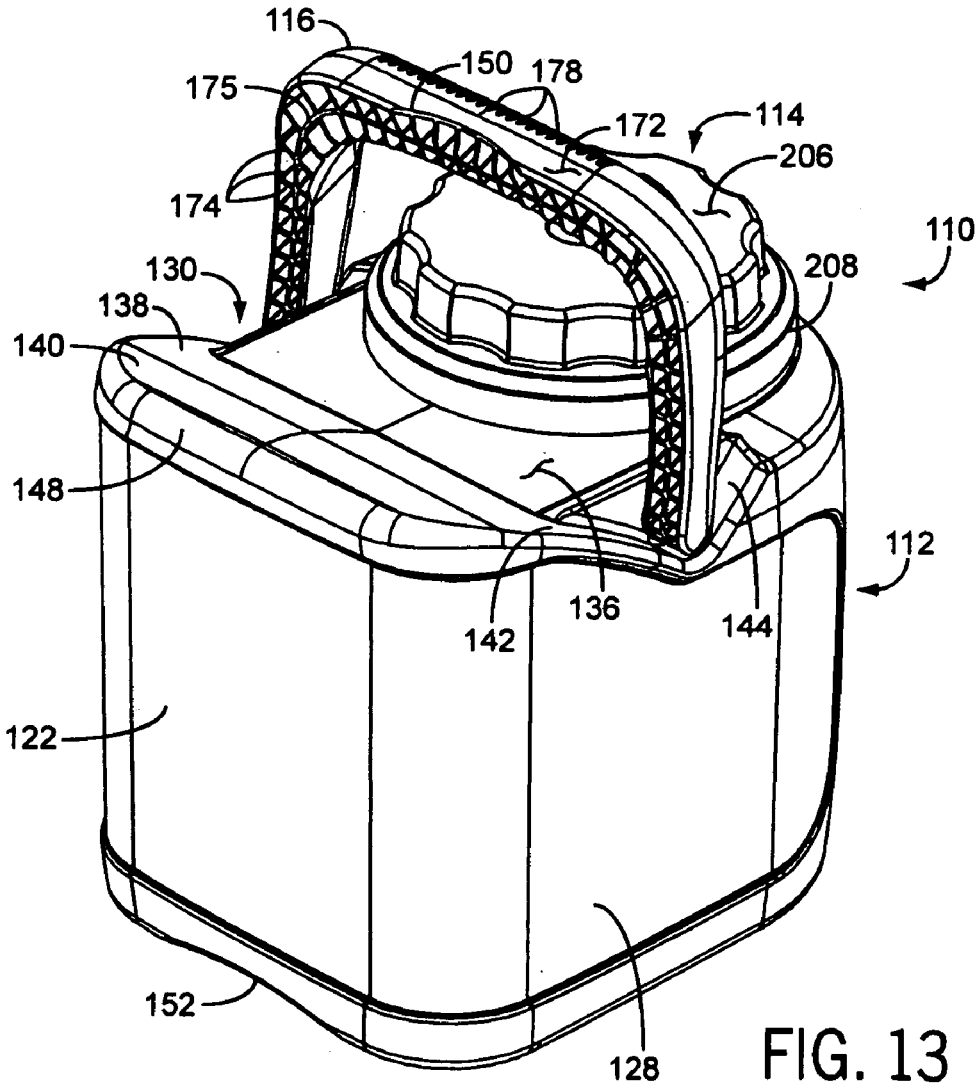
FIG. 13 is a perspective view of the front of the container of FIG. 11.
Figure 14:
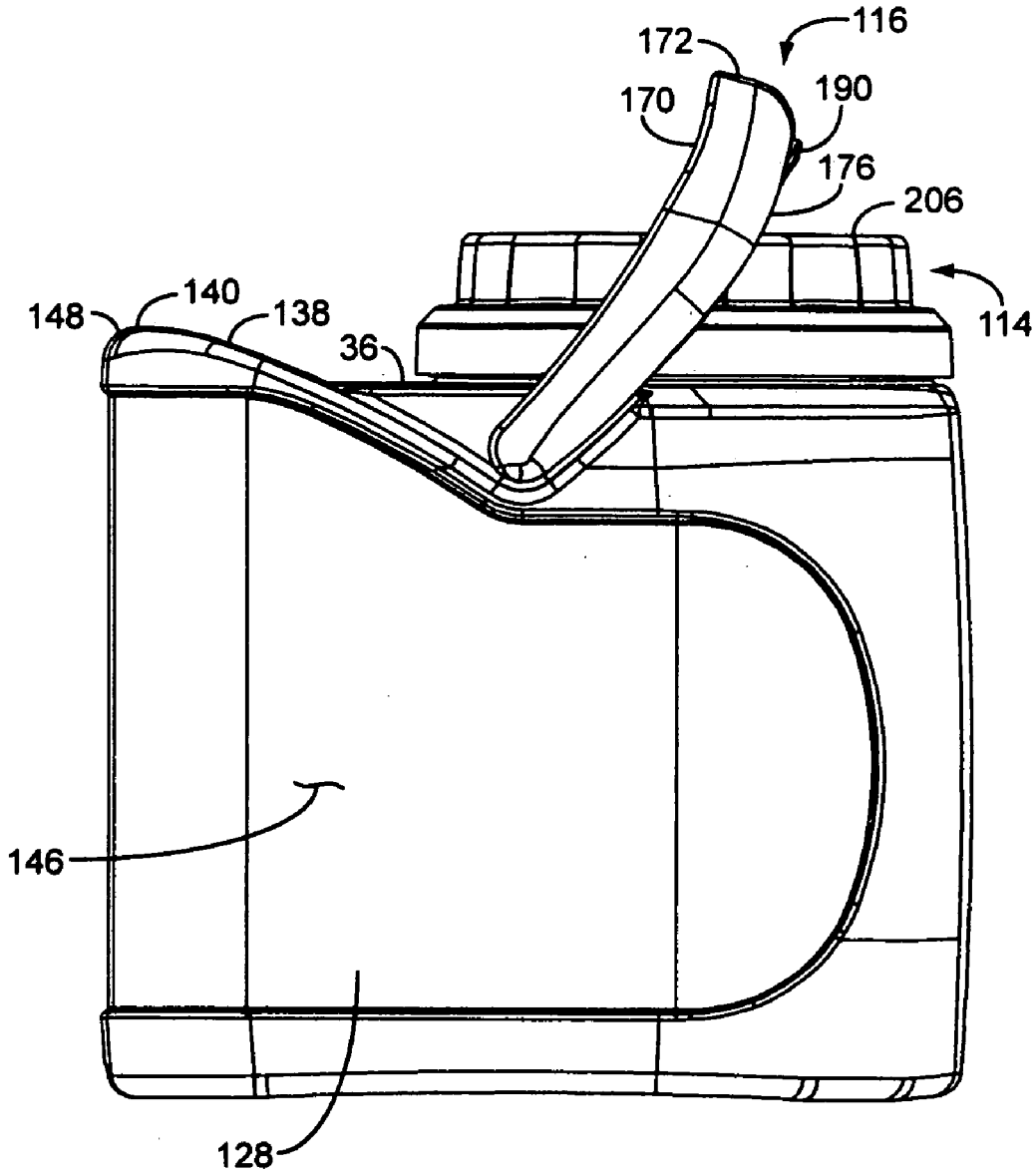
FIG. 14 is a side view of the container of FIG. 11.

Referring to FIGS. 13 and 14, handle 116 includes a lower surface 170 having substantially the same profile as handle support surface 144, transition region 138 and upper region 140 of body 112. As discussed above handle 116 includes a recess 150 extending upward into the bottom of the handle into a front surface 172 to provide a recess for a user to easily lift the handle from the upper surface 140 of the container. Handle 116 includes a honeycomb structure including a plurality of ribs 174 to provide strength and rigidity to the handle. A central rib 175 extends along the center of the handle to provide additional strength and rigidity. Of course a solid handle may also be used, however this adds cost and weight to the product. The handle may be plastic injection molded. Ribs 174 extend from the lower surface 170 upward toward the interior surface of top 176 of handle 116. As shown in FIG. 15, the exterior surface of handle top 176 includes a ribbed pattern 178 to provide a gripping surface for the user. The ribbed pattern 178 may be formed a softer material to provide additional comfort to the user. Handle 116 also includes a rear surface 180. When a user holds container 110 in the vertical position illustrated in FIG. 13, the rear surface 180 rests on the portion of a user's hand that is bearing the majority of the weight of the container. The honeycomb pattern rests against the tip of the user's fingers on an area that is not bearing the majority of the weight of the container. As illustrated in FIG. 11 handle 116 includes a recess 182 extending inwardly into the rear surface 180. Recess 182 provides a central position for the container to hang from a hook. Recess 182 prohibits the container from sliding along the rear surface 180 when the container is being supported by a hook attached to a support surface such as a ladder. Handle 16 may also include an aperture extending into a central portion of the handle configured to receive a hook or other member for hanging the container.

Figure 18:
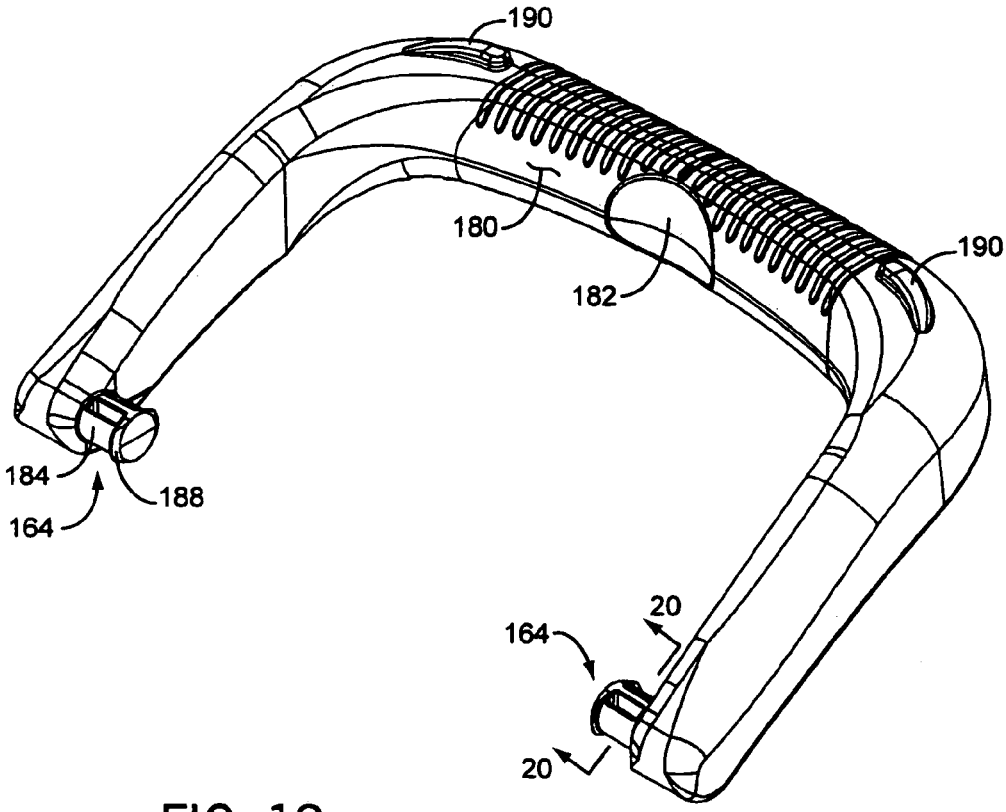
FIG. 18 is a perspective view of a handle.
Figure 19:
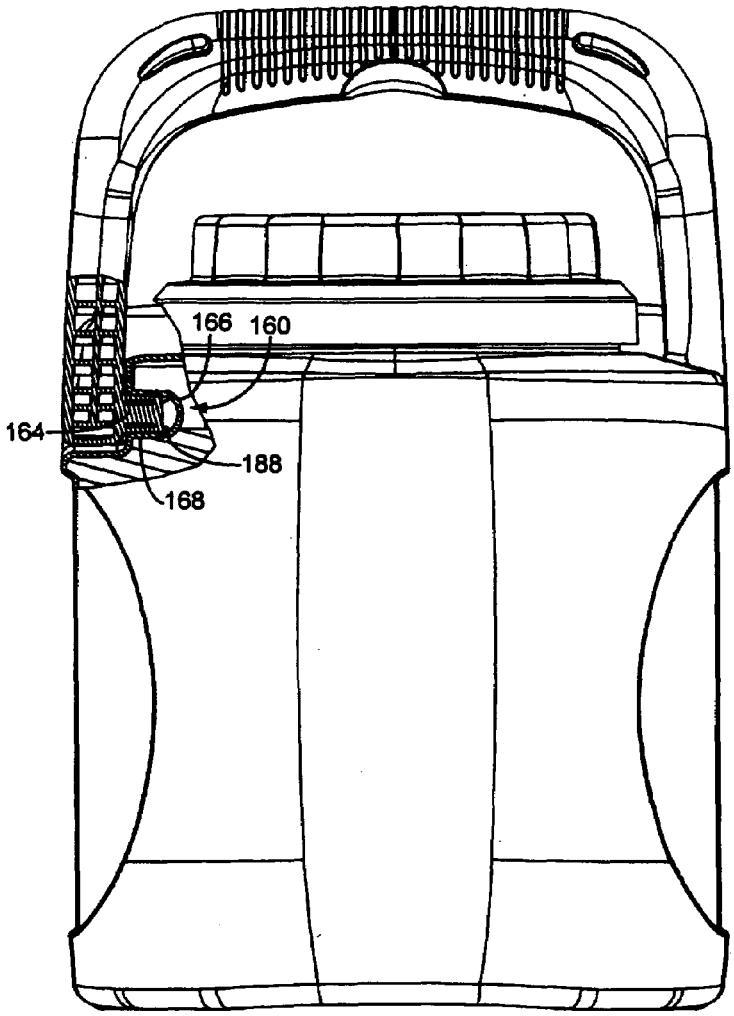
FIG. 19 is a partial detail cross-sectional view taken generally along lines 18—18 of FIG. 14.

Referring to FIG. 18, each trunnion includes bearing surfaces 184 and 185 and a pair of extensions 188 extend radially outwardly beyond the bearing surfaces 184. In one embodiment each extension 188 extends 0.05 inches radially outwardly beyond the bearing surface 184. As discussed above, the fore/aft opening of recesses 160 is large enough to receive the extensions. However, the up/down dimension of the recess is not sufficient to receive the extensions. Accordingly, the extensions 188 of trunnions 164 are aligned with the fore/aft dimension of the recess 160 when handle 116 is in the resting position proximate front wall 122. As handle 116 is rotated from the rest position shown in FIG. 11 to the vertical position shown in FIG. 13, extensions 188 engage the interior wall 168 of recesses 160. The resilient nature of the container permits the handle to rotate about the recesses. However, the frictional fit that results from the interference between extensions 188 and interior wall 168 of recess 160 permits the handle to remain in the vertical position or in any other position without falling either toward rear wall 124 or front wall 122. This feature allows a user to place the handle in a preferred position and have the handle remain in that position unattended. Additionally, when the cap is off the body of the container, the frictional fit will keep the handle from moving toward the spout area. Support surface 144 further ensures that even if handle 116 is pushed toward rear wall 124, it will not fall completely in front of the pouring edge of spout 118. Further the interference fit of extensions 188 and interior wall 168 also resist movement of the legs of handle 116 from spreading outwardly that could result in the trunnions being dislodged from the recesses. In this manner handle 116 remains attached to body 112 even when the handle is supporting the full weight of the paint in the container.

In one preferred embodiment, the clearance between a center region of handle 116 proximate handle recess 150 and support recess 182 and the top of cap 114 is one inch when handle 116 is substantially vertical as illustrated in FIG. 13. When top portion 176 of the legs of the U-shaped handle 116 is adjacent handle support surface 144 the clearance between the center region the top of cap 114 is 0.5 inches. Of course other clearances may be designed, however, there should be sufficient clearance to allow a user to freely carry and pour the paint from the container.

The width of handle support regions 142 and 144 are at least as wide as handle 116 so that the outer periphery of handle 116 does not extend beyond the outer periphery of body 112. Similarly, the pivot connection of handle 116 is located such that the front surface 172 of handle 116 does not extend beyond front wall 122.

Handle 116 further includes two raised tabs 190 that have the same height from bottom 120 as does the top of cap 114, when the cap 114 is threadably attached to the neck of the body. The bottom 120 includes two stacking recesses 192 configured to receive the tab 190 of handle 116. The provides a positive locator for stacked containers as well as stability to the stacked containers 110. Tabs 190 extend in both the cross container direction and fore/aft direction resulting in a positive location in both directions. However, the tabs 190 and/or recesses 192 could be configured to constrain the stacked container in a single direction.

Referring to FIGS. 15–17, spout 118 includes a drain back feature in which paint that spills over the upper edge 194 of the spout flows back into the interior of container 110 and not over the outer walls of container 110. Spout 118 includes an inner wall 196 terminating in upper edge 194 over which the paint is poured. An outer wall 198 extends upward from a lower edge of inner wall 196 forming a channel therebetween. Paint that enters the channel flows toward an opening 202 opposite the apex 200 of the spout. Opening 202 may be a discontinuity in the inner wall 196 or in the form of an opening in the channel portion between the inner and outer walls 196, 198.

Figure 22:
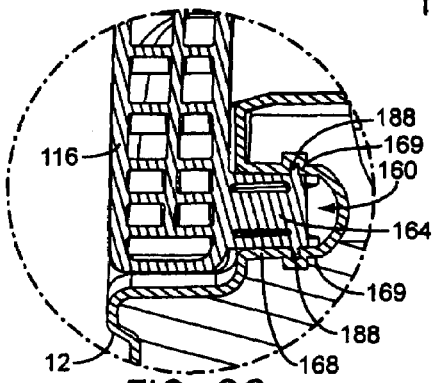
FIG. 22 is a detailed sectional view of an embodiment of a handle pivot including a groove in the wall of a recess configured to receive an extension on a tab or trunnion on the handle.
Figure 20:
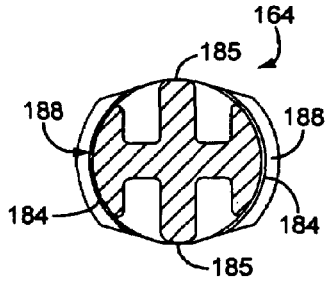
FIG. 20 is a cross-sectional view taken generally along lines 20—20 of FIG. 18.
Figure 21:
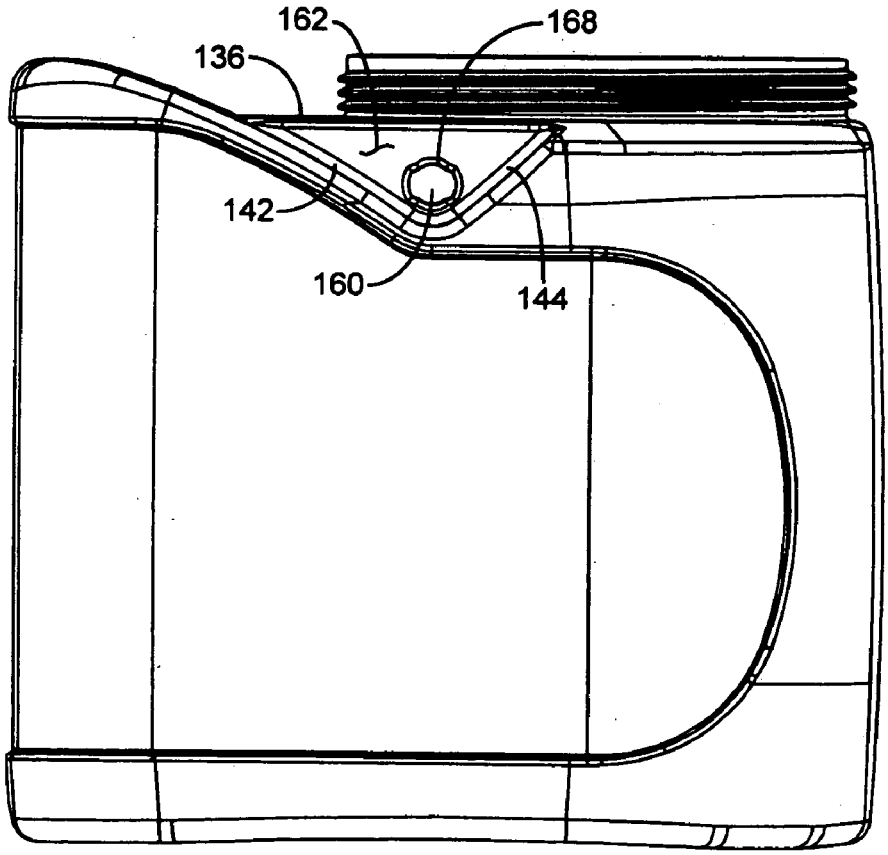
FIG. 21 is a side view of the container body of FIG. 11.
Figure 23:
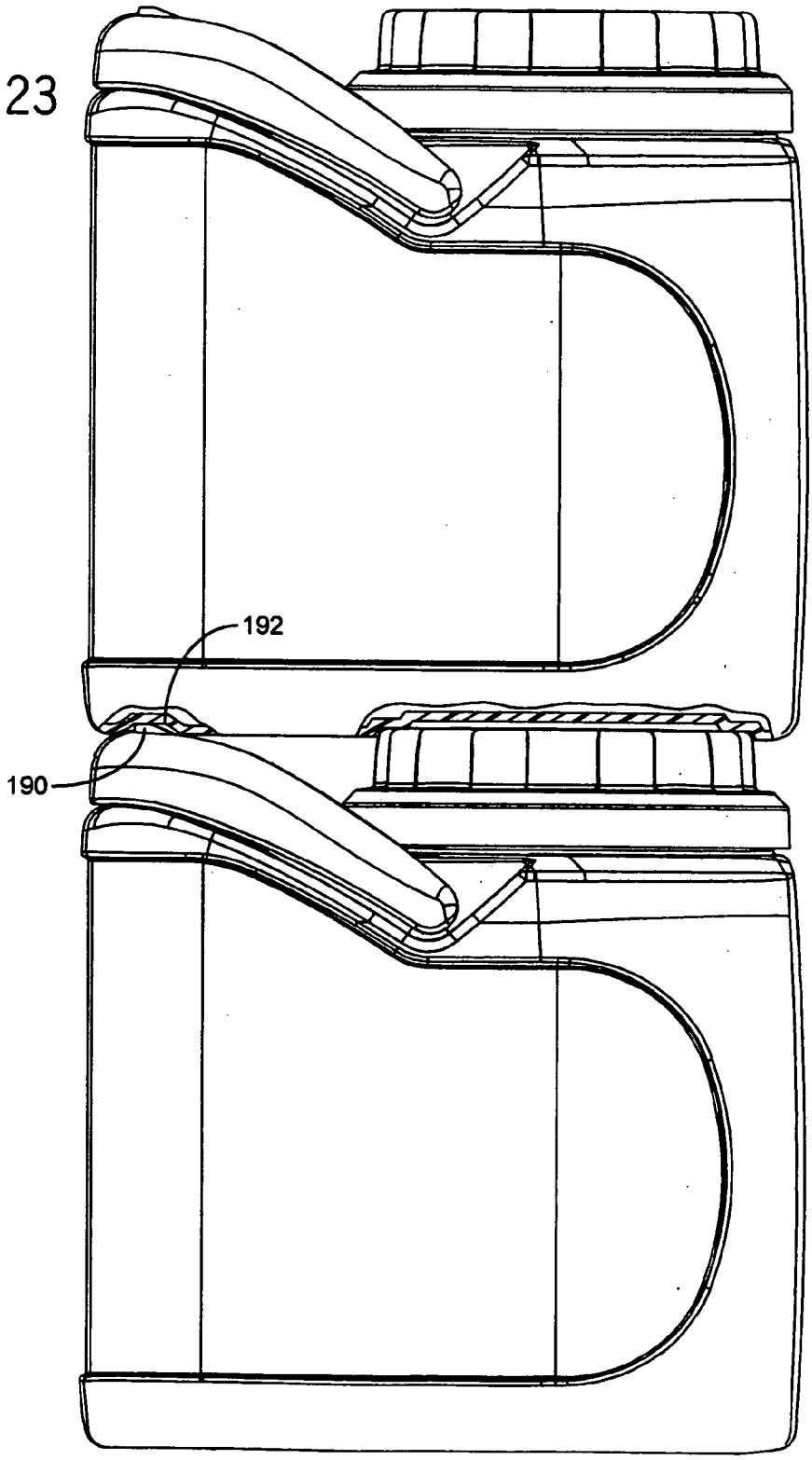
FIG. 23 is a side view of two stacked containers shown in FIG. 11.

The upper edge 194 includes a first region proximate apex 200 and two straight planar portions 204 extending in a "v" shape away from the first region. The straight portions 204 serve as a brush wipe to wipe excess paint off of a brush. One of the two straight portions may be a solid continuous line, while, as shown in FIG. 22, the other may have fingers or undulations 210 in a comb like fashion for combing excess paint from a brush. In one embodiment, the distance between the apex and the furthest point from the apex in the opening of the container is sufficient to dip a 3.5 inch paint brush directly into the interior of the container. In one embodiment the straight edge portion is at least 2 inches in length. Other lengths of the straight portion may be employed.

Cap 114 serves both as a cover and a paint dish. Cap 114 includes a downwardly extending wall extending from the top 206 of cap 114 and extends between the inner and outer walls 196, 198 of spout 118. Cap 114 further includes an outer wall 208 having internal threads that threadably engage the outer threads 134 of neck 132. Cap 114 may also include an indentation or recess on the top of the cap that receives a molded in logo and/or a dab of paint allowing the user to identify the color of the paint by the color of the dab of paint on the lid. The dab of paint could be on a white or colored sticker placed in the recess or detente on the top of the cap. In one embodiment the diameter of the cap is four inches and includes a plurality of detents or undulations to permit a user to easily grip and rotate the cap. In one embodiment the cap diameter is four inches.

Further modifications may be made in the design, arrangement and combination of the elements without departing from the scope of the invention as expressed in the appended claims For example a top member including one or more of the features discussed above such as the spout, reclamation structure, paint brush support, cap support, and others may be integrally formed with the body member or may be fastened to the container as a separate component. Additionally, the container may include transparent areas to allow the user to see the contents of the container. Further the cap attachment may include a transparent area to indicate whether the cap is securely attached to the container to prevent paint from accidentally being spilled. Although the container has been referred to as a paint container other liquids may be stored and poured as well. While some of the features have a unique application to the storage and application of paint, other features may be used for other liquids as well. Additionally, the label that is applied to the container may include a blank white portion to permit the user or manufacture to dab or paint an sample of the paint in the container to clearly show what color is contained within the container and how it will appear when painted on a white background. It is also noted that the features described in the specification and shown in the Figures either alone or in combination may also be combined with individual or multiple features disclosed herein or in the priority applications noted above. These and other modifications may be made in the design, arrangement and combination of the elements without departing from the scope of the invention as expressed in the appended claims.

What is claimed is:

1. A container comprising:

a body having a top, a bottom and at least one side wall; and a handle coupled to the body, the handle including a center portion including a top surface and a raised region projecting from the top surface and offset from a center of the center portion, and the bottom including a support surface contacting a portion of a top surface of a handle of a second container, the support surface including a recess receiving a raised region of the second container;

a cap removably coupled to the body, the cap having a top surface which is a predetermined distance from the bottom, the raised region being at the same distance from the bottom as the top of the cap when the handle is in a rest position proximate the top of the body, the handle including an access recess that is adjacent the top of the body when the handle is in the rest position, wherein the handle includes a pair of trunnions received in a respective pair of recesses in the body.

2. The container of claim 1, wherein the body includes a recess between the bottom and the side wall.

3. The container of claim 2, further including a spout proximate the top of the body.

* * * * *

UNITED STATES PATENT AND TRADEMARK OFFICE

CERTIFICATE OF CORRECTION

PATENT NO. : 7,156,265 B2
APPLICATION NO. : 10/255564
DATED : January 2, 2007
INVENTOR(S) : Walsh et al.

It is certified that error appears in the above-identified patent and that said Letters Patent is hereby corrected as shown below:

On The Title Page

Item [*] Notice: Subject to any disclaimer, the term of this patent is extended or adjusted under 35 USC 154(b) by 382 days Delete the phrase "by 382 days" and insert -- by 324 days--

Signed and Sealed this

Twenty-third Day of October, 2007

JON W. DUDAS
*Director of the United States Patent and Trademark Office*